US012171272B2

(12) United States Patent
Borges et al.

(10) Patent No.: US 12,171,272 B2
(45) Date of Patent: Dec. 24, 2024

(54) AEROSOL-GENERATING DEVICE COMPRISING A COVER ELEMENT SENSOR

(71) Applicant: Philip Morris Products S.A., Neuchatel (CH)

(72) Inventors: Miguel Borges, Neuchatel (CH); Jean-Luc Fringeli, Singapore (SG); Ilario Melzi, Cernusco sul Naviglio (IT); Stefano Pietro Pozzi, Renate (IT); Alberto Silvano, Milan (IT)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/422,376

(22) Filed: Jan. 25, 2024

(65) Prior Publication Data

US 2024/0156173 A1 May 16, 2024

Related U.S. Application Data

(63) Continuation of application No. 16/970,438, filed as application No. PCT/EP2019/055930 on Mar. 8, 2019, now Pat. No. 11,963,553.

(30) Foreign Application Priority Data

Mar. 9, 2018 (EP) ..... 18161075

(51) Int. Cl.
*A24F 40/53* (2020.01)
*A24F 40/40* (2020.01)
(Continued)

(52) U.S. Cl.
CPC ..... *A24F 40/53* (2020.01); *A24F 40/40* (2020.01); *A24F 40/42* (2020.01); *A24F 40/20* (2020.01)

(58) Field of Classification Search
CPC ..... A24F 40/40; A24F 40/42; A24F 40/50; A24F 40/51; A24F 40/53
See application file for complete search history.

(56) References Cited

U.S. PATENT DOCUMENTS 5,934,289 A 8/1999 Watkins et al.
9,826,780 B2 11/2017 Krietzman
(Continued)

FOREIGN PATENT DOCUMENTS

CN 101130121 A 2/2008
CN 104770878 A 7/2015
(Continued)

OTHER PUBLICATIONS

International Search Report and Written Opinion issued May 22, 2019 in PCT/EP2019/055930 filed Mar. 8, 2019.
(Continued)

*Primary Examiner* — Marcus E Harcum
(74) *Attorney, Agent, or Firm* — Oblon, McClelland, Maier & Neustadt, L.L.P.

(57) ABSTRACT

An aerosol-generating device is provided, including a housing; a cavity; an aperture at least partially defined by the housing and being positioned at an end of the cavity for insertion of the article into the cavity through the aperture; a cover element arranged for movement relative to the housing between a closed position partially covering the aperture and an open position partially uncovered; a sensor including a Hall effect sensor to provide an electrical signal indicative of a position of the cover element; an electrical heater to heat the article within the cavity and extending around an outer surface of an article received within the cavity; and an indicator element for movement relative to the sensor when moved between the closed and the open positions, the signal being determined by a position of the
(Continued)

indicator element relative to the sensor, the indicator element including a magnetic material.

18 Claims, 18 Drawing Sheets

(51) Int. Cl.
*A24F 40/42* (2020.01)
*A24F 40/20* (2020.01)

(56) References Cited

U.S. PATENT DOCUMENTS

| | | | |
|---|---|---|---|
| 10,709,171 | B2 | 7/2020 | Laakso |
| 2007/0125765 | A1 | 6/2007 | Nelson |
| 2013/0042865 | A1 | 2/2013 | Monsees et al. |
| 2013/0312742 | A1 | 11/2013 | Monsees et al. |
| 2016/0235122 | A1 | 8/2016 | Krietzman |
| 2016/0235123 | A1 | 8/2016 | Krietzman |
| 2016/0235124 | A1 | 8/2016 | Krietzman |
| 2016/0374400 | A1 | 12/2016 | Monsees et al. |
| 2017/0079331 | A1 | 3/2017 | Monsees et al. |
| 2017/0202268 | A1 | 7/2017 | Li |
| 2017/0304567 | A1 | 10/2017 | Adelson |
| 2017/0347709 | A1 | 12/2017 | Laakso et al. |
| 2019/0029322 | A1 | 1/2019 | Krietzman |
| 2020/0093185 | A1 | 3/2020 | Lim |

FOREIGN PATENT DOCUMENTS

| | | | |
|---|---|---|---|
| CN | 206687163 | U | 12/2017 |
| CN | 107692317 | A | 2/2018 |
| CN | 107752130 | A | 3/2018 |
| DE | 10 2014 014 415 | A1 | 3/2016 |
| EP | 0 951 219 | A1 | 10/1999 |
| EP | 2 740 508 | A1 | 6/2014 |
| GB | 2 542 021 | A | 3/2017 |
| JP | 2001-502542 | A | 2/2001 |
| JP | 2004-212103 | A | 7/2004 |
| JP | 2006-153641 | A | 6/2006 |
| JP | 2006-229667 | A | 8/2006 |
| JP | 2007-274872 | A | 10/2007 |
| JP | 2009-188538 | A | 8/2009 |
| JP | 2015-204833 | A | 11/2015 |
| RU | 2 531 890 | C2 | 10/2014 |
| RU | 2 536 032 | C2 | 12/2014 |
| TW | 201740827 | A | 12/2017 |
| WO | WO 98/17130 | A1 | 4/1998 |
| WO | WO 2013/102611 | A2 | 7/2013 |
| WO | WO 2016/187695 | A1 | 12/2016 |
| WO | WO 2017/182976 | A1 | 10/2017 |
| WO | WO 2017/194751 | A1 | 11/2017 |
| WO | WO 2018/216961 | A1 | 11/2018 |
| WO | WO 2019/170893 | A1 | 9/2019 |
| WO | WO 2019/170896 | A1 | 9/2019 |

OTHER PUBLICATIONS

Decision to Grant issued Jun. 24, 2022 in Russian Patent Application No. 2020133153 (with English translation), citing documents 23-26 therein, 15 pages.

English translation of Combined Taiwanese Office Action and Search Report issued Jun. 29, 2022 in Patent Application No. 108106266, citing document 27 therein, 5 pages.

Office Action issued Jan. 12, 2023, in Japanese Patent Application No. 2020-541894 (with English translation), citing documents 12 therein, 3 pages.

Extended European Search Report issued Apr. 18, 2023 in European Patent Application No. 22208144.0, citing documents 28-30 therein, 6 pages.

Chinese Notice of Allowance and Search Report mailed on Aug. 24, 2023 issued in Chinese Patent Application No. 201980013111.7 filed on Mar. 8, 2019, with English Translation, total 7 pages (citing documents 31 and 32, therein).

Taiwanese Office Action and Search Report mailed on Sep. 15, 2023 issued in Taiwanese Patent Application No. 112112543 filed on Feb. 25, 2019, with English Translation, total 12 pages (citing document 33 therein).

Japanese Office Action mailed on Dec. 11, 2023 issued in Japanese Patent Application 2023-085141 filed on May 24, 2023, with English Translation, total 10 pages (citing documents 34-36, therein).

Japanese Office Action issued Jun. 20, 2024 in Japanese Patent Application No. 2023-085141 (with English Translation), citing references 15-19 therein, 8 pages.

European Notice of Allowance issued May 2, 2024 in European Patent Application No. 22208144.0, citing reference 15 therein, 57 pages.

Philippine Office Action issued Jun. 4, 2024 in Philippine Patent Application No. 1-2020/500610, citing reference 1 therein, 6 pages.

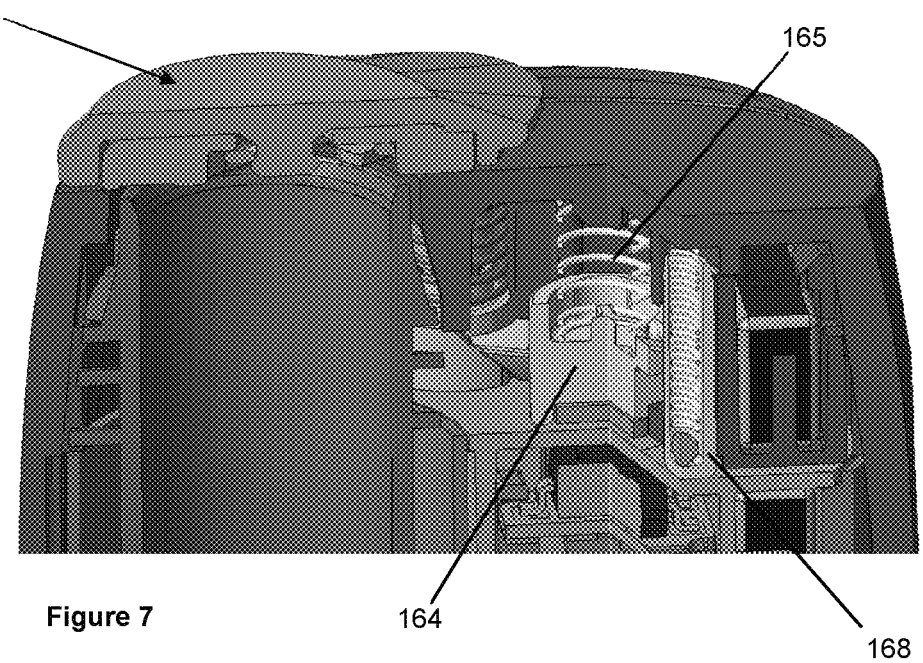
Figure 7
Figure 8
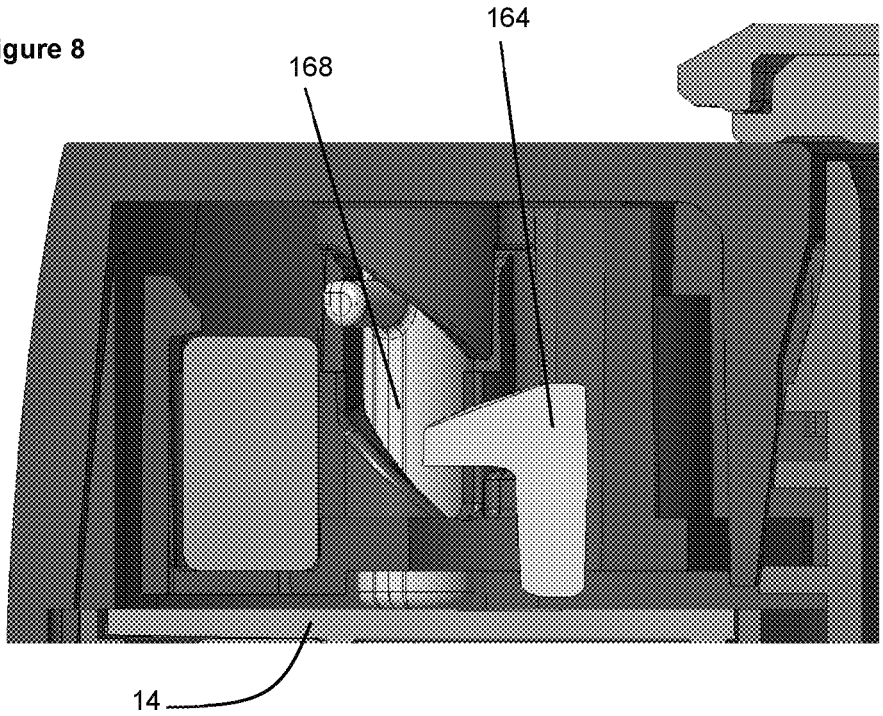

AEROSOL-GENERATING DEVICE COMPRISING A COVER ELEMENT SENSOR

CROSS-REFERENCE TO RELATED APPLICATIONS

This application is a continuation of and claims benefit under 35 U.S.C. § 120 to U.S. application Ser. No. 16/970,438, filed Aug. 17, 2020, which is a U.S. National Stage application of PCT/EP2019/055930, filed on Mar. 8, 2019, and claims the benefit of priority under 35 U.S.C. § 119 from EP 18161075.9, filed on Mar. 9, 2018, the entire contents of each of which are incorporated herein by reference.

TECHNICAL FIELD

The present invention relates to an aerosol-generating device comprising a moveable cover element and a sensor arranged to provide an electrical signal indicative of the position of the cover element. The present invention also relates to an aerosol-generating system comprising the aerosol-generating device and an aerosol-generating article.

DESCRIPTION OF THE RELATED ART

One type of aerosol-generating system is an electrically operated smoking system. Known handheld electrically operated smoking systems typically comprise an aerosol-generating device comprising a battery, control electronics and an electric heater for heating an aerosol-generating article designed specifically for use with the aerosol-generating device. In some examples, the aerosol-generating article comprises an aerosol-forming substrate, such as a tobacco rod or a tobacco plug, and the heater contained within the aerosol-generating device is inserted into or located around the aerosol-forming substrate when the aerosol-generating article is inserted into the aerosol-generating device. In an alternative electrically operated smoking system, the aerosol-generating article may comprise a capsule containing an aerosol-forming substrate, such as loose tobacco.

In known electrically operated smoking systems the aerosol-generating article may be received within a cavity in the aerosol-generating device. Some aerosol-generating devices may comprise a sliding cover that a user may slide over an opening of the cavity when the aerosol-generating device is not being used. However, typically the function of such covers is limited. For example, the cover is typically manually operated and does not interact with any other elements of the aerosol-generating device.

It would be desirable to provide an aerosol-generating device comprising a cover element that facilitates improved operation of the aerosol-generating device.

SUMMARY

According to a first aspect of the present invention there is provided an aerosol-generating device comprising a housing, a cavity for receiving an aerosol-generating article, and an aperture at least partially defined by the housing. The aperture is positioned at an end of the cavity for insertion of an aerosol-generating article into the cavity through the aperture. The aerosol-generating device also comprises a cover element arranged for movement with respect to the housing between a closed position in which the cover element at least partially covers the aperture and an open position in which the aperture is at least partially uncovered.

The aerosol-generating device also comprises a sensor arranged to provide an electrical signal indicative of the position of the cover element with respect to the aperture.

BRIEF DESCRIPTION OF THE DRAWINGS

The invention will now be further described, by way of example only, with reference to the accompanying drawings in which:

FIGS. 7 to 18 illustrate the operation of the mechanical linkage of FIG. 6;

DETAILED DESCRIPTION

Figure 1:
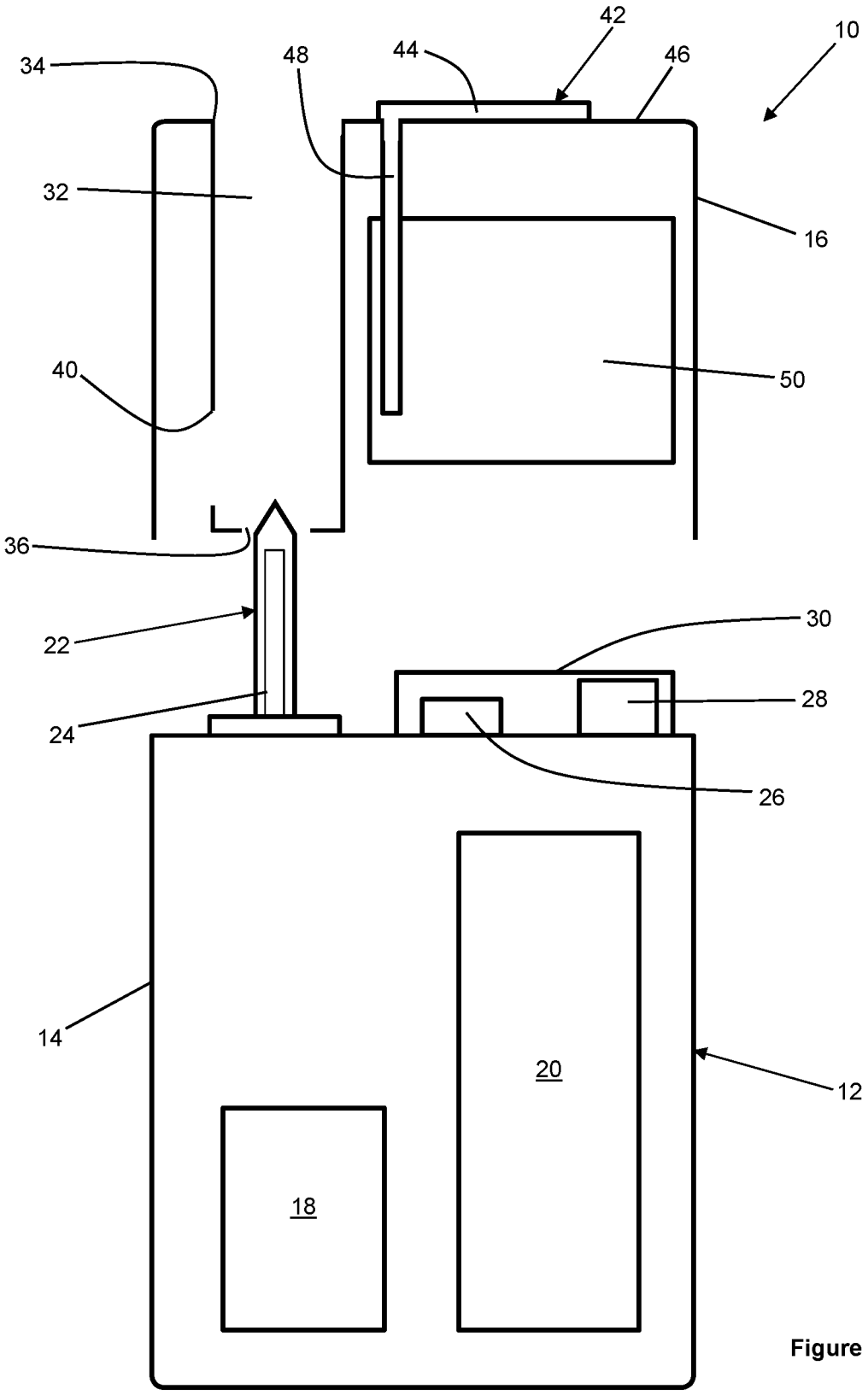
FIG. 1 shows a cross-sectional view of an aerosol-generating device according to an embodiment of the present invention.

Advantageously, the electrical signal provided by the sensor facilitates operation of other elements of the aerosol-generating device depending on the position of the cover element. For example, in some embodiments described herein, the aerosol-generating device may comprise an electrical heater, wherein operation of the electrical heater is dependent on the signal provided by the sensor.

The sensor may be arranged to directly sense the position of the cover element relative to the sensor.

The aerosol-generating device may comprise an indicator element arranged for movement with respect to the sensor when the cover element is moved between the closed position and the open position, wherein the electrical signal provided by the sensor is determined by the position of the indicator element relative to the sensor. Advantageously, the indicator element may be optimised for sensing by the sensor. For example, the indicator element may comprise at least one of a size, a shape, and a material that may be optimised for sensing by the sensor.

The indicator element may be connected to the cover element. The indicator element may be directly connected to the cover element. The indicator element may be formed integrally with the cover element. The indicator element may be formed separately from the cover element and attached to the cover element. For example, the indicator element may be attached to the cover element by at least one of an adhesive, an interference fit, and a weld.

The indicator element may be arranged for movement with respect to the sensor and the cover element. For example, the aerosol-generating device may comprise a mechanical linkage arranged to translate movement of the cover element between the closed position and the open position into movement of the indicator element with respect to the sensor.

Advantageously, the mechanical linkage may facilitate desired positioning of the cover element, the indicator element and the sensor in the aerosol-generating device.

Advantageously, the mechanical linkage may translate a desired motion of the cover element into a different motion of the indicator element, wherein the different motion of the indicator element is optimised for sensing by the sensor. For example, the mechanical linkage may translate a rotational motion of the cover element into a translational motion of the indicator element with respect to the sensor.

The cover element may be rotatable with respect to the housing between the closed position and the open position. Advantageously, a rotatable cover element may be easier for a user to operate than a sliding cover element. For example, when a user is holding the aerosol-generating device with a hand, a rotational movement of the thumb of the same hand may be a more natural movement than a sliding motion. Therefore, advantageously, a rotatable cover element facilitates holding the aerosol-generating device and operating the cover element with a single hand. Advantageously, holding the aerosol-generating device and operating the cover element with a single hand facilitates insertion of an aerosol-generating article into the cavity. For example, a user may hold the aerosol-generating device in one hand and operate the cover element with the same hand, and at the same time use the remaining hand to hold an aerosol-generating article and insert the aerosol-generating article into the cavity. Known devices require a user to use both hands to hold the aerosol-generating device and operate a cover element before the user can pick up and insert an article into the device.

The mechanical linkage may comprise at least one of a cam and a gear.

Preferably, the cover element comprises a cover portion and a shaft portion extending from the cover portion, wherein the cover portion is arranged to at least partially cover the aperture when the cover element is in the closed position, and wherein the shaft portion is received within the housing. Advantageously, the shaft portion may facilitate rotation of the cover element between the closed position and the open position.

The cover portion and the shaft portion may be formed separately and attached to each other. For example, the cover portion and the shaft portion may be attached to each other using at least one of an adhesive, an interference fit, and a weld.

The cover portion and the shaft portion may be integrally formed. For example, the cover portion and the shaft portion may be formed as a single piece using a molding process.

The cover portion may be substantially planar. The cover portion may be disc-shaped.

Preferably, the shaft portion extends orthogonally with respect to the cover portion.

In embodiments in which the aerosol-generating device comprises a mechanical linkage, the mechanical linkage may comprise at least one of a cam and a gear connected to the shaft portion of the cover element.

The shaft portion may be formed separately from and attached to at least one of a cam and a gear. For example, the shaft portion may be attached to at least one of a cam and a gear using at least one of an adhesive, an interference fit, and a weld.

The shaft portion may be integrally formed with at least one of a cam and a gear. For example, the shaft portion and at least one of a cam and a gear may be formed as a single piece using a molding process.

In embodiments in which the aerosol-generating device comprises a mechanical linkage, the indicator element may comprise at least one of a cam, a cam follower and a gear.

In embodiments in which the aerosol-generating device comprises a mechanical linkage, the indicator element may be connected to at least one of a cam, a cam follower and a gear. The indicator element may be formed integrally with the cam, the cam follower or the gear. The indicator element may be formed separately from the cam, the cam follower or the gear, and attached to the cam, the cam follower or the gear. For example, the indicator element may be attached to the cam, the cam follower or the gear by at least one of an adhesive, an interference fit, and a weld.

Preferably, the aerosol-generating device comprises a biasing mechanism arranged to bias the cover element away from the open position and towards the closed position. Advantageously, the biasing mechanism may eliminate the need for a user to manually move the cover element into the closed position. Advantageously, the biasing mechanism may reduce the risk of accidental movement of the cover element away from the closed position and towards the open position. Advantageously, during use, the biasing mechanism may bias the cover element against and aerosol-generating article received within the cavity, which may inhibit movement of the aerosol-generating article during use.

In embodiments in which the aerosol-generating device comprises a mechanical linkage, the mechanical linkage may comprise the biasing mechanism.

The biasing mechanism may comprise a torsion spring. Advantageously, a torsion spring may be particularly suitable for providing a rotational biasing force to bias the rotatable cover element away from the open position and towards the closed position. A rotational biasing force may also be referred to as torque.

In embodiments in which the cover element comprises a shaft portion, the torsion spring may be arranged to act directly on the shaft portion. For example, the cover element may comprise a tab extending from the shaft portion and arranged to engage an end of the torsion spring.

The biasing mechanism may comprise a first gear connected to the shaft portion of the cover element and a second gear connected to the torsion spring, wherein the first gear is engaged with the second gear to translate torque from the torsion spring to the shaft portion.

The first gear and the shaft portion may be formed separately and attached to each other. For example, the first gear and the shaft portion may be attached to each other using at least one of an adhesive, an interference fit, and a weld.

The first gear and the shaft portion may be integrally formed. For example, the first gear and the shaft portion may be formed as a single piece using a molding process.

The biasing mechanism may comprise a spring holder in which the torsion spring is at least partially received, wherein at least a portion of an outer surface of the spring holder forms the second gear.

The torsion spring may be retained in the spring holder by an interference fit.

The biasing mechanism may comprise a cam surface, wherein the spring holder is engaged with the cam surface and functions as a cam follower when the spring holder rotates relative to the cam surface. Preferably, the spring holder and the cam surface are arranged so that, when the spring holder rotates during rotation of the cover element, the spring holder moves relative to the sensor. The indicator element may comprise the spring holder. The indicator element may be connected to the spring holder.

Preferably, when the cover element is in the closed position, the cam follower is positioned at a first distance from the sensor. Preferably, when the cover element is in the open position, the cam follower is positioned at a second distance from the sensor, wherein the second distance is different from the first distance.

The cam surface may be at least partially defined by the housing.

The biasing mechanism may comprise a spring holder biasing element to bias the spring holder towards the cam surface. The biasing mechanism may comprise a compression spring. Preferably, the torsion spring is a coiled torsion spring arranged to additionally function as a compression spring so that the spring holder biasing element is the torsion spring.

The biasing mechanism may comprise a cap, wherein the torsion spring is positioned between the spring holder and the cap. Advantageously, the cap may retain the torsion spring within the spring holder.

Preferably, the spring holder is rotatable with respect to the cap. Preferably, the torsion spring comprises a first end engaged with the cap and a second end engaged with the spring holder.

Preferably, the biasing mechanism comprises a spindle extending from the cap, wherein the torsion spring extends around the spindle. Preferably, the spring holder is rotatable about the spindle. Advantageously, the spindle may facilitate correct positioning of the torsion spring during assembly of the biasing mechanism.

The spindle and the cap may be formed separately and attached to each other. For example, the spindle and the cap may be attached to each other using at least one of an adhesive, an interference fit, and a weld.

The spindle and the cap may be integrally formed. For example, the spindle and the cap may be formed as a single piece using a molding process.

The biasing mechanism may comprise a chassis on which at least one of the shaft portion, the torsion spring, the first gear, the second gear, the spring holder, the cap, and the spindle is received. Preferably, the cap is connected to the chassis to retain the spring holder and the torsion spring between the cap and the chassis. Preferably, the cap is connected to the chassis by an interference fit.

The aerosol-generating device may comprise a first detent arranged to retain the cover element in the open position. Advantageously, the first detent increases the force required to rotate the cover element out of the open position. Therefore, the first detent may be particularly advantageous in embodiments in which the aerosol-generating device comprises a biasing mechanism. For example, the biasing force provided by the biasing mechanism may be insufficient to move the cover element out of the open position when a portion of the aerosol-generating device is engage with the detent. Therefore, the aerosol-generating device may require additional force from the user to overcome the first detent, at which point the biasing mechanism is sufficient to continue rotation of the cover element into the closed position.

The first detent may be arranged to engage a protrusion on at least one of the cover element, the cover portion, the shaft portion, the first gear, the second gear, and the spring holder. The first detent may be formed by at least one of the housing, the biasing mechanism cap and the biasing mechanism chassis.

The aerosol-generating device may comprise a second detent arranged to retain the cover element in the closed position. Advantageously, the second detent increases the force required to rotate the cover element out of the closed position. Therefore, advantageously, the second detent may reduce the risk of accidental opening of the cover element.

The second detent may be arranged to engage a protrusion on at least one of the cover element, the cover portion, the shaft portion, the first gear, the second gear, and the spring holder. The second detent may be formed by at least one of the housing, the biasing mechanism cap and the biasing mechanism chassis.

The aerosol-generating device may comprise the first detent, the second detent, or both the first detent and the second detent.

In embodiments in which the aerosol-generating device comprises the first detent and the second detent, the aerosol-generating device may comprise a common detent that functions as both the first detent and the second detent. The common detent may be arranged to engage a first protrusion on at least one of the cover element, the cover portion, the shaft portion, the first gear, the second gear, and the spring holder to retain the cover element in the open position. The common detent may be arranged to engage a second protrusion on at least one of the cover element, the cover portion, the shaft portion, the first gear, the second gear, and the spring holder to retain the cover element in the closed position.

In embodiments in which the aerosol-generating device comprises separate first and second detents, at least one of the cover element, the cover portion, the shaft portion, the first gear, the second gear, and the spring holder may define a common protrusion. Preferably, the common protrusion is arranged to engage the first detent when the cover element is in the open position. Preferably, the common detent is arranged to engage the second detent when the cover element is in the closed position.

The aerosol-generating device may comprise a first mechanical stop arranged to prevent rotation of the cover element beyond the closed position when the cover element is rotated from the open position to the closed position.

The first mechanical stop may be arranged to engage at least one of the cover element, the cover portion, the shaft portion, the first gear, the second gear, and the spring holder. The first mechanical stop may be formed by at least one of the housing, the biasing mechanism cap and the biasing mechanism chassis.

The aerosol-generating device may comprise a second mechanical stop arranged to prevent rotation of the cover element beyond the open position when the cover element is rotated from the closed position to the open position.

The second mechanical stop may be arranged to engage at least one of the cover element, the cover portion, the shaft portion, the first gear, the second gear, and the spring holder. The second mechanical stop may be formed by at least one of the housing, the biasing mechanism cap and the biasing mechanism chassis.

The aerosol-generating device may comprise the first mechanical stop, the second mechanical stop, or both the first mechanical stop and the second mechanical stop.

In embodiments in which the aerosol-generating device comprises the first mechanical stop and the second mechanical stop, the aerosol-generating device may comprise a common mechanical stop that functions as both the first mechanical stop and the second mechanical stop. The common mechanical stop may be arranged to engage a first portion of at least one of the cover element, the cover portion, the shaft portion, the first gear, the second gear, and the spring holder to retain the cover element in the open position. The common mechanical stop may be arranged to engage a second portion of at least one of the cover element, the cover portion, the shaft portion, the first gear, the second gear, and the spring holder to retain the cover element in the closed position.

The housing may comprise a first housing and a second housing. The second housing may be arranged for movement relative to the first housing. The aperture may be at least partially defined by the second housing. The cover element may be arranged for movement with respect to the second housing between the closed position and the open position.

The aerosol-generating device may comprise a latching mechanism arranged to retain the cover element in the open position and arranged to release the cover element when the second housing is moved relative to the first housing.

The latching mechanism is arranged to retain the cover element in the open position. Therefore, advantageously, the latching mechanism facilitates insertion of an aerosol-generating article into the cavity. For example, when a user is ready to use the aerosol-generating device, the user may move the cover element from the closed position and into the open position. When the cover element reaches the open position, the latching mechanism retains the cover element in the open position and eliminates the need for the user to hold the cover element in the open position while inserting an aerosol-generating article into the cavity.

In embodiments in which the aerosol-generating device comprises a mechanical linkage, the mechanical linkage may comprise the latching mechanism.

Preferably, the latching mechanism is positioned within the second housing.

The aerosol-generating device may comprise a closing mechanism arranged to move the cover element away from the open position and into the closed position when the latching mechanism releases the cover element.

The latching mechanism is arranged to release the cover element and the closing mechanism is arranged to move the cover element into the closed position when the second housing is moved relative to the first housing. Therefore, advantageously, the latching mechanism and the closing mechanism may provide automatic closing of the cover element when the second housing is moved relative to the first housing.

In embodiments in which the aerosol-generating device comprises a mechanical linkage, the mechanical linkage may comprise the closing mechanism.

Preferably, the closing mechanism is positioned within the second housing.

Preferably, the second housing is arranged for sliding movement relative to the first housing.

Preferably, the second housing at least partially defines the cavity. The cavity may comprise a first end defined by the aperture and a second end opposite the first end, wherein the second end is at least partially closed. Advantageously, when an aerosol-generating article is received within the cavity, moving the second housing away from the first housing may also move the aerosol-generating article away from the second housing. Advantageously, moving the aerosol-generating article away from the first housing may facilitate removal of the aerosol-generating article from the aerosol-generating device. Advantageously, facilitating removal of the aerosol-generating article with movement of the second housing away from the first housing may prompt a user to move the second housing relative to the first housing when removing the aerosol-generating article. Therefore, advantageously, the user is prompted to release the cover element from the latching mechanism so that the closing mechanism may move the cover element into the closed position when the aerosol-generating article is removed from the cavity.

The latching mechanism may be arranged to release the cover element when the second housing is moved away from the first housing. The latching mechanism may be arranged to release the cover element when the second housing is moved towards the first housing.

Preferably, the closing mechanism is arranged to move the cover element into the closed position when the second housing is moved towards the first housing.

The latching mechanism may comprise a cam connected to the shaft portion of the cover element, the cam defining a cam surface, and a cam follower positioned within the second housing and engaged with the cam surface. The cam surface defines a detent in which the cam follower is received when the cover element is in the open position. Advantageously, when the cam follower is received within the detent, relative movement between the cam follower and the cam surface is prevented. Therefore, when the cam follower is received within the detent, the shaft portion is unable to rotate and the cover element is retained within the open position.

Preferably, the cam follower and the cam surface are arranged so that, when the cam rotates during rotation of the cover element, the cam follower moves relative to the sensor. The indicator element may comprise the cam follower. The indicator element may be connected to the cam follower.

Preferably, when the cover element is in the closed position, the cam follower is positioned at a first distance from the sensor. Preferably, when the cover element is in the open position, the cam follower is positioned at a second distance from the sensor, wherein the second distance is different from the first distance.

The cam and the shaft portion may be formed separately and attached to each other. For example, the cam and the shaft portion may be attached to each other using at least one of an adhesive, an interference fit, and a weld.

The cam and the shaft portion may be integrally formed. For example, the cam and the shaft portion may be formed as a single piece using a molding process.

The latching mechanism may comprise a cam follower biasing element arranged to bias the cam follower against the cam surface. Advantageously, the cam follower biasing element may facilitate movement of the cam follower into the detent when the cover element is moved into the open position. The cam follower biasing element may comprise a compression spring.

The latching mechanism may comprise a release pin positioned within the second housing and arranged for movement with respect to the second housing, wherein the first housing is arranged to engage the release pin when the second housing is moved relative to the first housing to bias the release pin against the cam follower to disengage the cam follower from the detent.

Preferably, the release pin is moveable between a first position when the second housing is moved away from the first housing and a second position when the second housing is moved towards the first housing, wherein the latching mechanism further comprises a release pin biasing element arranged to bias the release pin towards the first position.

Preferably, when the second housing is moved towards the first housing, the first housing pushes against the first end of the release pin to overcome the biasing force of the release pin biasing element to move the release pin towards the second position. Preferably, when the release pin is in the second position, the release pin is engaged with the cam follower to disengage the cam follower from the detent.

The release pin biasing element may comprise a compression spring.

The closing mechanism may comprise a cover biasing element arranged to bias the cover element towards the closed position. The cover biasing element may comprise a torsion spring.

In embodiments in which the cover element comprises a shaft portion, the cover biasing element may be engaged with the shaft portion.

In embodiments in which the latching mechanism comprises a cam, the cover biasing element may be engaged with the cam.

The latching mechanism may comprise a first gear connected to the shaft portion of the cover element and a geared cam follower positioned within the second housing. A surface of the geared cam follower defines a second gear engaged with the first gear. The latching mechanism also comprises a first cam surface fixed with respect to the second housing, wherein the geared cam follower is engaged with the first cam surface. The first cam surface defines a detent in which the geared cam follower is received when the cover element is in the open position. Advantageously, when the geared cam follower is received within the detent, relative movement between the cam follower and the first cam surface is prevented. Therefore, when the cam follower is received within the detent, the shaft portion is unable to rotate and the cover element is retained within the open position.

Preferably, the geared cam follower and the first cam surface are arranged so that, when the first gear rotates during rotation of the cover element, the geared cam follower moves relative to the sensor. The indicator element may comprise the geared cam follower. The indicator element may be connected to the geared cam follower.

Preferably, when the cover element is in the closed position, the geared cam follower is positioned at a first distance from the sensor. Preferably, when the cover element is in the open position, the geared cam follower is positioned at a second distance from the sensor, wherein the second distance is different from the first distance.

The first gear and the shaft portion may be formed separately and attached to each other. For example, the first gear and the shaft portion may be attached to each other using at least one of an adhesive, an interference fit, and a weld.

The first gear and the shaft portion may be integrally formed. For example, the first gear and the shaft portion may be formed as a single piece using a molding process.

The first cam surface may be defined by the second housing.

The latching mechanism may comprise a chassis defining the first cam surface, wherein the chassis is fixed relative to the second housing.

The latching mechanism may comprise a cam follower biasing element arranged to bias the geared cam follower against the first cam surface. Advantageously, the cam follower biasing element may facilitate movement of the geared cam follower into the detent when the cover element is moved into the open position. The cam follower biasing element may comprise a compression spring.

The latching mechanism may comprise a release element positioned within the second housing and arranged for movement with respect to the second housing, wherein the first housing is arranged to engage the release pin when the second housing is moved relative to the first housing to bias the release element against the geared cam follower to disengage the geared cam follower from the detent.

Preferably, the release element is moveable between a first position when the second housing is moved away from the first housing and a second position when the second housing is moved towards the first housing, wherein the latching mechanism further comprises a release element biasing element arranged to bias the release element towards the first position.

Preferably, when the second housing is moved towards the first housing, the first housing pushes against the first end of the release element to overcome the biasing force of the release element biasing element to move the release element towards the second position. Preferably, when the release element is in the second position, the release pin is engaged with the geared cam follower to disengage the geared cam follower from the detent.

The release element biasing element may comprise a compression spring.

The closing mechanism may comprise a second cam surface fixed with respect to the second housing, wherein the release element is arranged to engage the second cam surface to rotate the release element from the second position to a third position. The release element is arranged to engage the geared cam follower so that, when the release element rotates from the second position to the third position, the release element rotates the geared cam follower to move the cover element from the open position to the closed position.

The second cam surface may be defined by the second housing.

The latching mechanism may comprise a chassis defining the second cam surface, wherein the chassis is fixed relative to the second housing.

In embodiments in which the housing comprises a first housing and a second housing, preferably the sensor is positioned within the first housing.

In embodiments in which the housing comprises a first housing and a second housing, the second housing may be detachable from the first housing. Advantageously, detaching the second housing from the first housing may facilitate cleaning of one or more internal components of the aerosol-generating device.

The sensor may be arranged to provide at least one of an electrical signal indicative of the second housing being detached from the first housing and an electrical signal indicative of the second housing being attached to the first housing. Advantageously, an electrical signal indicative of whether the second housing is attached to the first housing facilitates operation of other elements of the aerosol-generating device depending on whether the second housing is attached to the first housing. For example, in some embodiments described herein, the aerosol-generating device may comprise an electrical heater, wherein operation of the electrical heater is dependent on the electrical signal indicative of whether the second housing is attached to the first housing.

In embodiments in which the aerosol-generating device comprises an indicator element, the sensor may be arranged to provide an electrical signal indicative of the second housing being detached from the first housing when the sensor does not sense the indicator element.

In embodiments in which the aerosol-generating device comprises an indicator element, the sensor may be arranged to provide an electrical signal indicative of the second housing being attached to the first housing when the sensor does sense the indicator element.

In any of the embodiments described herein in which the aerosol-generating device comprises an indicator element, the indicator element may comprises a magnetic material and the sensor may comprise at least one of a reed switch and a Hall effect sensor.

The indicator element may comprise an optical surface and the sensor may comprise an optical sensor. The optical surface may comprise a reflective material. The reflective material may comprise a metallic material.

The optical sensor may comprise a light transmitter and a light receiver. As used herein, the term "light" refers to electromagnetic radiation.

Preferably, the light transmitter is arranged to transmit light having at least one wavelength. The light may comprise at least one wavelength in the visible portion of the electromagnetic spectrum. The visible portion of the electromagnetic spectrum comprises wavelengths of between about 390 nanometres and about 700 nanometres. The light may comprise at least one wavelength in the infrared portion of the electromagnetic spectrum. The infrared portion of the electromagnetic spectrum comprises wavelengths of between about 700 nanometres and about 1 millimetre.

Preferably, the light receiver is sensitive to at least one wavelength of light transmitted by the light transmitter.

Preferably, the light transmitter is arranged to transmit light towards the indicator element. Preferably, the light transmitter is arranged to receive light transmitted from the light transmitter and reflected, scattered, or reflected and scattered by the indicator element.

The light transmitter may comprise at least one of a light emitting diode and a laser.

The light receiver may comprise at least one of a photodiode and a phototransistor.

Preferably, the cover element is arranged so that, when the cover element is in the closed position, the cover element covers at least about 50 percent of the aperture, more preferably at least about 60 percent of the aperture, more preferably at least about 70 percent of the aperture, more preferably at least about 80 percent of the aperture, more preferably at least about 90 percent of the aperture, more preferably at least about 95 percent of the aperture.

Preferably, the cover element is arranged so that the cover element entirely covers the aperture when the cover element is in the closed position. In other words, preferably the cover element is arranged so that the cover element covers 100 percent of the aperture when the cover element is in the closed position. Advantageously, arranging the cover element to entirely cover the aperture when the cover element is in the closed position may prevent the insertion of foreign objects into the cavity when the aerosol-generating device is not being used.

Preferably, the cover element is arranged so that the cover element covers less than about 5 percent of the aperture when the cover element is on the open position.

Preferably, the cover element is arranged so that the aperture is entirely uncovered when the cover element is in the open position. In other words, preferably the cover element is arranged so that the cover element covers none of the aperture when the cover element is in the open position. Advantageously, arranging the cover element so that the aperture is entirely uncovered when the cover element is in the open position facilitates insertion of an aerosol-generating article into the cavity.

The housing may comprise an end wall, wherein the aperture extends through a first portion of the end wall. Preferably, the cover element is arranged to overlie a second portion of the end wall when the cover portion is in the open position. Advantageously, arranging the cover element to overlie a second portion of the end wall when the cover portion is in the open position may reduce the risk of damage to the cover element when the aerosol-generating device is being used with the cover element in the open position.

In embodiments in which the cover element comprises a shaft portion, preferably the shaft portion extends through an opening in the housing end wall. Preferably, the opening is positioned on a central portion of the end wall, wherein the central portion is positioned between the first portion of the end wall and the second portion of the end wall.

In embodiments in which the housing comprises a first housing and a second housing, preferably the second housing comprises the end wall.

Preferably, the aerosol-generating device comprises a heater arranged to heat an aerosol-generating article when the aerosol-generating article is received within the cavity.

The heater may comprise an electrical heater.

The electrical heater may be positioned outside the cavity.

The electrical heater may be positioned within the cavity.

The electrical heater may be arranged to extend around and outer surface of an aerosol-generating article received within the cavity.

The electrical heater may be coil-shaped. The electrical heater may be configured to heat a fluid transport structure. The aerosol-generating device may comprise a fluid transport structure, wherein the electrical heater is arranged to heat the fluid transport structure. The fluid transport structure may comprise a wick. The electrical heater may be coil-shaped, wherein the electrical heater is coiled around the fluid transport structure.

The electrical heater may extend into the cavity. The electrical heater may be arranged to be received within an aerosol-generating article when the aerosol-generating article is inserted into the cavity. The electrical heater may be an elongate electrical heater. The electrical heater may be blade-shaped. The electrical heater may be pin-shaped. The electrical heater may be cone-shaped.

The electrical heater may comprise an inductive heating element. During use, the inductive heating element inductively heats a susceptor material to heat an aerosol-generating article received within the cavity. The susceptor material may form part of the aerosol-generating device. The susceptor material may form part of the aerosol-generating article.

The electrical heater may comprise a resistive heating element. During use, an electrical current is supplied to the resistive heating element to generate heat by resistive heating.

Suitable materials for forming the resistive heating element include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, TIMETAL® and iron-manganese-aluminium based alloys.

In some embodiments, the resistive heating element comprises one or more stamped portions of electrically resistive material, such as stainless steel. Alternatively, the resistive heating element may comprise a heating wire or filament, for example a Ni—Cr (Nickel-Chromium), platinum, tungsten, or alloy wire.

The electrical heater may comprise an electrically insulating substrate, wherein the resistive heating element is provided on the electrically insulating substrate. The electrically insulating substrate may be a ceramic material such as Zirconia or Alumina. Preferably, the electrically insulating substrate has a thermal conductivity of less than or equal to about 2 Watts per metre Kelvin.

Preferably, the aerosol-generating device comprises a power supply and a controller. Preferably, the controller is arranged to supply power from the power supply to the electrical heater during use of the aerosol-generating device. Preferably, the controller is arranged to supply power from the power supply to the sensor during use of the aerosol-generating device.

Preferably, the controller is arranged to control a supply of power to the electrical heater in response to a signal received from the sensor.

Preferably, the controller is arranged to supply power from the power supply to the electrical heater according to a predetermined heating cycle when the aerosol-generating device is used to heat an aerosol-generating article received within the cavity.

Preferably, the controller is arranged to supply power from the power supply to the electrical heater according to the predetermined heating cycle only when the controller receives a signal from the sensor indicative of the cover element being in the open position. Preferably, the controller is arranged to prevent a supply of power from the power supply to the electrical heater according to the predetermined heating cycle when the controller receives a signal from the sensor indicative of the cover element being in the closed position.

In embodiments in which the electrical heater comprises a resistive heating element, the controller may be arranged to supply power from the power supply to the resistive heating element according to a predetermined pyrolysis cycle to clean the electrical heater when there is not an aerosol-generating article received within the cavity. The pyrolysis cycle may clean the electrical heater by pyrolysis of residue remaining on the electrical heater after use of the aerosol-generating device to heat one or more aerosol-generating articles. Typically, the maximum temperature to which the electrical heater is heated during a pyrolysis cycle is higher than the maximum temperature to which the electrical heater is heated during a heating cycle to heat an aerosol-generating article. Typically, the total duration of a pyrolysis cycle is shorter than the total duration of a heating cycle.

Preferably, the controller is arranged to supply power from the power supply to the electrical heater according to the predetermined pyrolysis cycle only when the controller receives a signal from the sensor indicative of the cover element being in the closed position. Preferably, the controller is arranged to prevent a supply of power from the power supply to the electrical heater according to the predetermined pyrolysis cycle when the controller receives a signal from the sensor indicative of the cover element being in the open position.

In embodiments in which the housing comprises a second housing detachable from the first housing, preferably, the controller is arranged to supply power from the power supply to the electrical heater only when the controller receives a signal from the sensor indicative of the second housing being attached to the first housing. Preferably, the controller is arranged to prevent the supply of power from the power supply to the electrical heater when the controller receives a signal from the sensor indicative of the second housing being detached from the first housing.

The power supply may be a DC voltage source. In preferred embodiments, the power supply is a battery. For example, the power supply may be a nickel-metal hydride battery, a nickel cadmium battery, or a lithium based battery, for example a lithium-cobalt, a lithium-iron-phosphate or a lithium-polymer battery. The power supply may alternatively be another form of charge storage device such as a capacitor. The power supply may require recharging and may have a capacity that allows for the storage of enough energy for use of the aerosol-generating device with one or more aerosol-generating articles.

Preferably, the aerosol-generating device comprises at least one air inlet. Preferably, the at least one air inlet is in fluid communication with an upstream end of the cavity. In embodiments in which the aerosol-generating device comprises an elongate electrical heater, preferably the elongate electrical heater extends into the cavity from the upstream end of the cavity.

In embodiments in which the housing comprises a first housing and a second housing, the at least one air inlet may be formed by a gap between the first housing and the second housing. In embodiments in which the second housing defines a heater opening through which an electrical heater extends into the cavity, preferably the heater opening is in fluid communication with the at least one air inlet.

The aerosol-generating device may comprise a sensor to detect air flow indicative of a user taking a puff. The air flow sensor may be an electro-mechanical device. The air flow sensor may be any of: a mechanical device, an optical device, an opto-mechanical device and a micro electro-mechanical systems (MEMS) based sensor. The aerosol-generating device may comprise a manually operable switch for a user to initiate a puff.

The aerosol-generating device may comprise a temperature sensor. The temperature sensor may be mounted on the printed circuit board. The temperature sensor may detect the temperature of the electrical heater or the temperature of an aerosol-generating article received within the cavity. The temperature sensor may be a thermistor. The temperature sensor may comprise a circuit configured to measure the resistivity of the electrical heater and derive a temperature of the electrical heater by comparing the measured resistivity to a calibrated curve of resistivity against temperature.

Advantageously, deriving the temperature of the electrical heater may facilitate control of the temperature to which the electrical heater is heated during use. The controller may be configured to adjust the supply of power to the electrical heater in response to a change in the measured resistivity of the electrical heater.

Advantageously, deriving the temperature of the electrical heater may facilitate puff detection. For example, a measured drop in the temperature of the electrical heater may correspond to a user puffing or drawing on the aerosol-generating device.

Preferably, the aerosol-generating device comprises an indicator for indicating when the electrical heater is activated. The indicator may comprise a light, activated when the electrical heater is activated.

The aerosol-generating device may comprise at least one of an external plug or socket and at least one external electrical contact allowing the aerosol-generating device to be connected to another electrical device. For example, the aerosol-generating device may comprise a USB plug or a USB socket to allow connection of the aerosol-generating device to another USB enabled device. The USB plug or socket may allow connection of the aerosol-generating device to a USB charging device to charge a rechargeable power supply within the aerosol-generating device. The USB plug or socket may support the transfer of data to or from, or both to and from, the aerosol-generating device. The aerosol-generating device may be connectable to a computer to transfer data to the aerosol-generating device, such as new heating profiles for new aerosol-generating articles.

In those embodiments in which the aerosol-generating device comprises a USB plug or socket, the aerosol-generating device may further comprise a removable cover that covers the USB plug or socket when not in use. In embodiments in which the USB plug or socket is a USB plug, the USB plug may additionally or alternatively be selectively retractable within the device.

According to a second aspect of the present invention there is provided an aerosol-generating system comprising an aerosol-generating device according to the first aspect of the present invention in accordance with any of the embodiments described herein. The aerosol-generating system also comprises an aerosol-generating article comprising an aerosol-forming substrate.

As used herein, the term "aerosol-generating article" refers to an article comprising an aerosol-forming substrate that, when heated, releases volatile compounds that can form an aerosol.

The aerosol-forming substrate may comprise a plug of tobacco. The tobacco plug may comprise one or more of: powder, granules, pellets, shreds, spaghettis, strips or sheets containing one or more of: tobacco leaf, fragments of tobacco ribs, reconstituted tobacco, homogenised tobacco, extruded tobacco and expanded tobacco. Optionally, the tobacco plug may contain additional tobacco or non-tobacco volatile flavour compounds, to be released upon heating of the tobacco plug. Optionally, the tobacco plug may also contain capsules that, for example, include the additional tobacco or non-tobacco volatile flavour compounds. Such capsules may melt during heating of the tobacco plug. Alternatively, or in addition, such capsules may be crushed prior to, during, or after heating of the tobacco plug.

Where the tobacco plug comprises homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The aerosol-generating article may have a total length of between approximately 30 millimetres and approximately 100 millimetres. The aerosol-generating article may have an external diameter of between approximately 5 millimetres and approximately 13 millimetres.

The aerosol-generating article may comprise a mouthpiece positioned downstream of the tobacco plug. The mouthpiece may be located at a downstream end of the aerosol-generating article. The mouthpiece may be a cellulose acetate filter plug. Preferably, the mouthpiece is approximately 7 millimetres in length, but can have a length of between approximately 5 millimetres to approximately 10 millimetres.

The tobacco plug may have a length of approximately 10 millimetres. The tobacco plug may have a length of approximately 12 millimetres.

The diameter of the tobacco plug may be between approximately 5 millimetres and approximately 12 millimetres.

In a preferred embodiment, the aerosol-generating article has a total length of between approximately 40 millimetres and approximately 50 millimetres. Preferably, the aerosol-generating article has a total length of approximately 45 millimetres. Preferably, the aerosol-generating article has an external diameter of approximately 7.2 millimetres.

Figure 2:
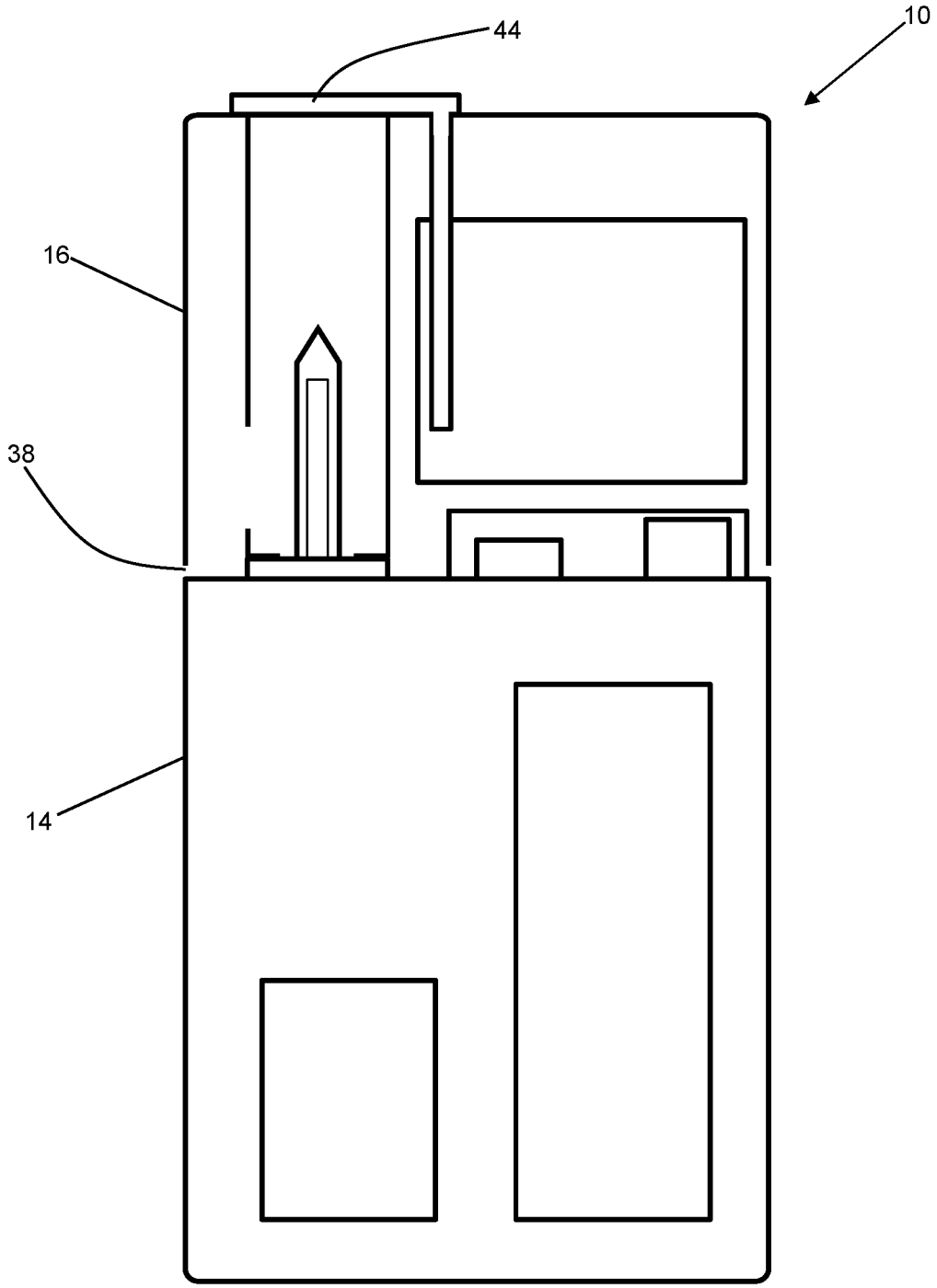
FIG. 2 shows a cross-sectional view of the aerosol-generating device of FIG. 1 with the second housing moved relative to the first housing.

FIGS. 1 and 2 show a cross-sectional view of an aerosol-generating device 10 according to an embodiment of the present invention. The aerosol-generating device 10 comprises a housing 12 comprising a first housing 14 and a second housing 16. The second housing 16 is slidable with respect to the first housing 14 between a compressed position shown in FIG. 2 and an expanded position shown in FIG. 1. The second housing 16 may also be detached from the first housing 14.

The aerosol-generating device 10 also comprises a controller 18 and a power supply positioned within the first housing 14, and a heater 22 extending from an end of the first housing 14. The power supply 20 is an electrical power supply comprising a rechargeable battery. The heater 22 is an electrical heater comprising a resistive heating element 24. During use, the controller 18 supplies power from the power supply 20 to the resistive heating element 24 to resistively heat the heater 22.

Positioned on the first housing 14 next to the heater 22 are a sensor 26 and a first magnet 28. The sensor 26 is an optical sensor comprising a light transmitter and a light receiver. The light transmitter is an infrared light emitting diode and the light receiver is a photodiode. The photodiode is sensitive to infrared light transmitted from the infrared light emitting diode. An optical window 30 overlies the sensor 26, wherein the optical window is transparent to the infrared light transmitted from the infrared light emitting diode.

The second housing 16 defines a cavity 32 for receiving an aerosol-generating article and an aperture 34 positioned at an end of the cavity 32. When the second housing 16 is attached to the first housing 14, the heater 22 extends into the cavity 32 via a heater opening 36 defined by the second housing 16. An air inlet 38 is formed by a gap between the first housing 14 and the second housing 16. The air inlet 38 is in fluid communication with the cavity 32 via an airflow opening 40 defined by the second housing 16.

When an aerosol-generating article is received within the cavity 32, the aerosol-generating article and the aerosol-generating device 10 together form an aerosol-generating system. During use, the heater 22 heats the aerosol-generating article received within the cavity 32 to generate an aerosol. When a user draws on the aerosol-generating article, air is drawn into the aerosol-generating device 10 via the air inlet 38 and into the cavity 32 through the airflow opening 40. The air then flows through the aerosol-generating article to deliver the generated aerosol to the user.

Figure 3:
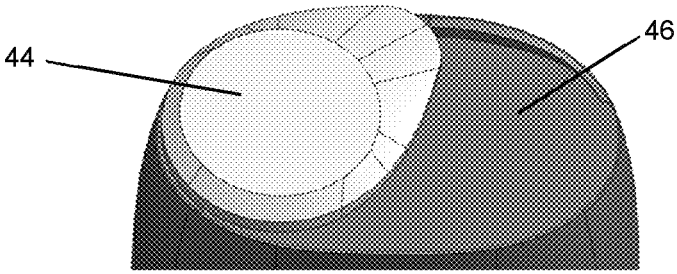
FIGS. 3 to 5 illustrate the rotational movement of the cover element of the aerosol-generating device of FIGS. 1 and 2.
Figure 4:
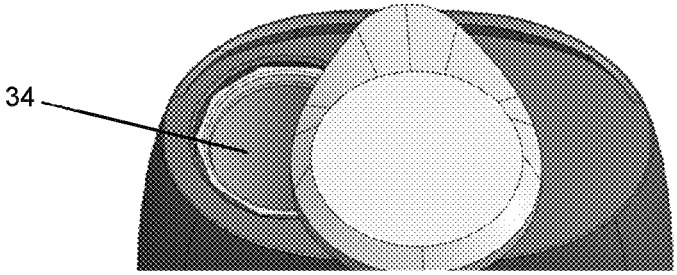
Figure 5:
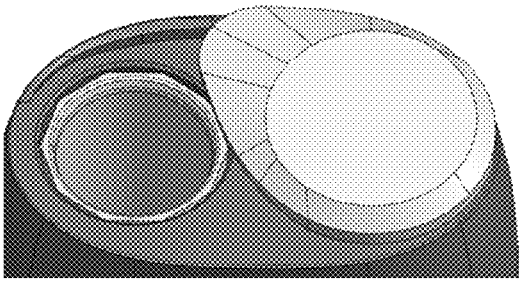

The aerosol-generating device 10 also comprises a cover element 42 comprising a cover portion 44 overlying an end wall 46 of the second housing 16 and a shaft portion 48 extending through the end wall 46. The cover element 42 is rotatable between a closed position in which the cover portion 44 covers the aperture 34 and an open position in which the cover portion 44 does not cover the aperture 34. The closed position is shown in FIG. 2 and the open position is shown in FIG. 1. FIGS. 3 to 5 illustrate the rotation of the cover element 42 from the closed position (FIG. 3) to the open position (FIG. 5).

Figure 6:
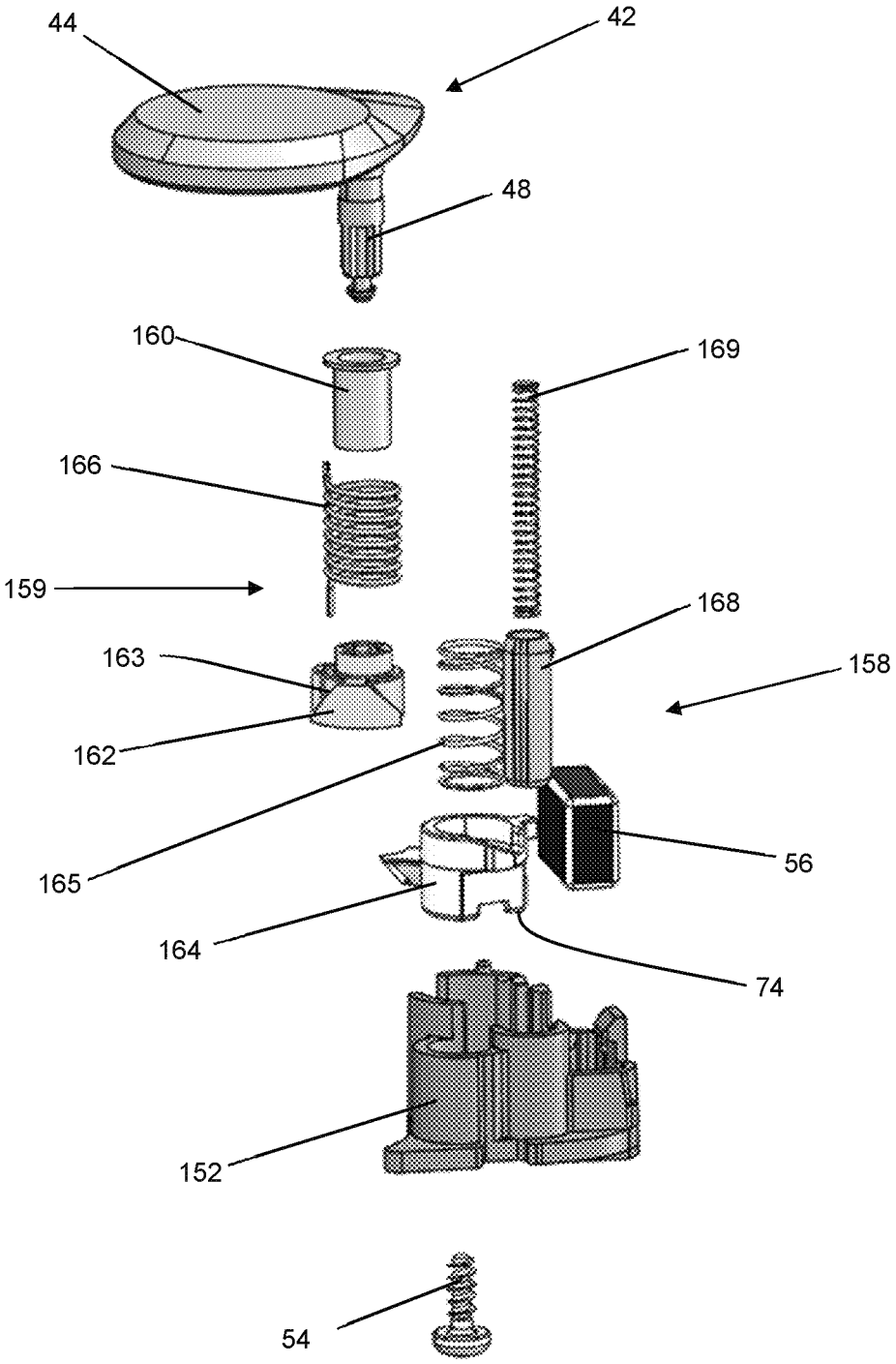
FIG. 6 shows an exploded perspective view of the mechanical linkage of the aerosol-generating device of FIGS. 1 and 2.
Figure 9:
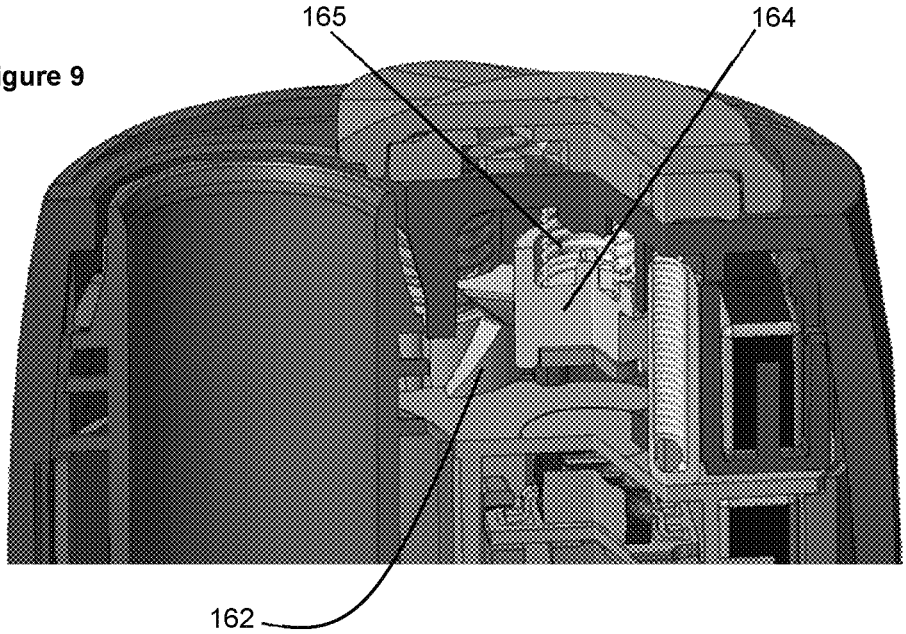

Positioned within the second housing 16 is a mechanical linkage 50 arranged to interact with the shaft portion 48 of the cover element 42. An exploded view of the mechanical linkage 50 is shown in FIG. 6.

The mechanical linkage 50 comprises a chassis 152 attached to the second housing 16 by a screw 54. Mounted onto the chassis 152 is second magnet 56 arranged to interact with the first magnet 28 on the first housing 14. In particular, the first and second magnets 28, 56 are magnetically attracted to each other to facilitate attachment of the second housing 16 to the first housing 14.

Also mounted on the chassis 152 are a latching mechanism 158 and a closing mechanism 159 comprising a bushing 160, a cam 162, a cam follower 164, a cam follower biasing spring 165, a torsion spring 166, a release pin 168 and a release pin biasing spring 169.

The cam 162 is connected to an end of the shaft portion 48 of the cover element 42 by an interference fit. Therefore, when the cover element 42 is rotated between the closed and open positions, the cam 162 is also rotated. The bushing 160 and the torsion spring 166 are positioned coaxially about the shaft portion 48 of the cover element 42.

The cam follower 164 is slidably received within the chassis 152 and engages a first cam surface 163 formed on the cam 162. Therefore, when the cam 162 rotates during rotation of the cover element 42, the cam follower 164 moves up and down within the chassis 152. An indicator element 74 comprising an optically reflective aluminium layer is positioned on a bottom surface of the cam follower 164. When the cam follower 164 moves up and down within the chassis 152, the sensor 26 senses a change in distance between the sensor 26 and the indicator element 74. Based on the sensed distance between the sensor 26 and the indicator element 74, the sensor 26 provides a signal to the controller 18 indicative of whether the cover element 42 is in the closed position or the open position.

If the signal from the sensor 26 is indicative of the cover element 42 being in the closed position, it is assumed that an aerosol-generating article is not received within the cavity 32 and the controller 18 will not supply power from the power supply 20 to the heater 22 for heating an aerosol-generating article.

If the signal from the sensor 26 is indicative of the cover element 42 being in the open position, an aerosol-generating article may be received within the cavity 32 and the controller 18 may supply power from the power supply 20 to the heater 22 for heating an aerosol-generating article.

If the sensor 26 cannot detect the indicator element 74 it is assumed that the second housing 16 has been detached from the first housing 14. In this case, the sensor 26 provides a signal to the controller 18 indicative of the second housing 16 being detached from the first housing 14 and the controller 18 will prevent the supply of power to the heater 22.

The operation of the latching mechanism 158 and the closing mechanism 159 will now be described with reference to FIGS. 7 to 18.

FIG. 7 shows the cover element 42 in the closed position. When the cover element 42 is in the closed position, the cam follower 164 is biased into a lowered position by the cam follower biasing spring 165 and the release pin 168 is maintained in a raised position by the first housing 14, as shown in FIG. 8.

Figure 10:
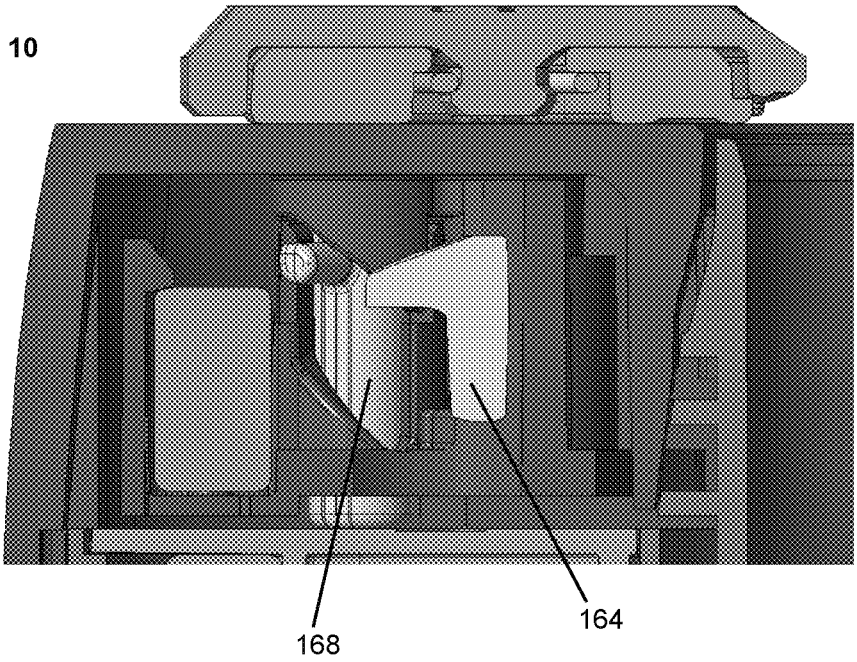

When the cover element 42 is rotated towards the open position, the rotation of the cam 162 raises the cam follower 164 into a raised position against the force of the cam follower biasing spring 165 and loads the torsion spring 166. As shown in FIG. 10, the release pin 168 remains in its raised position.

Figure 11:
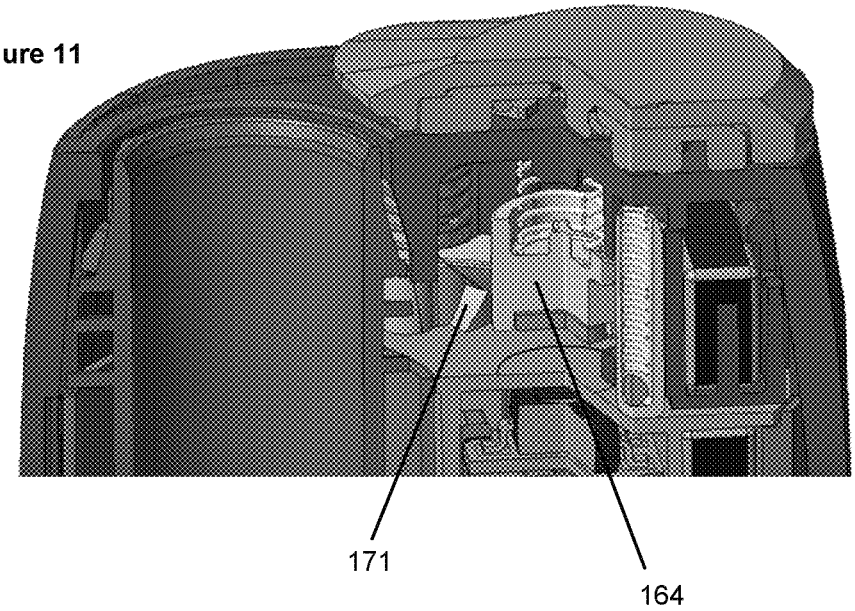
Figure 12:
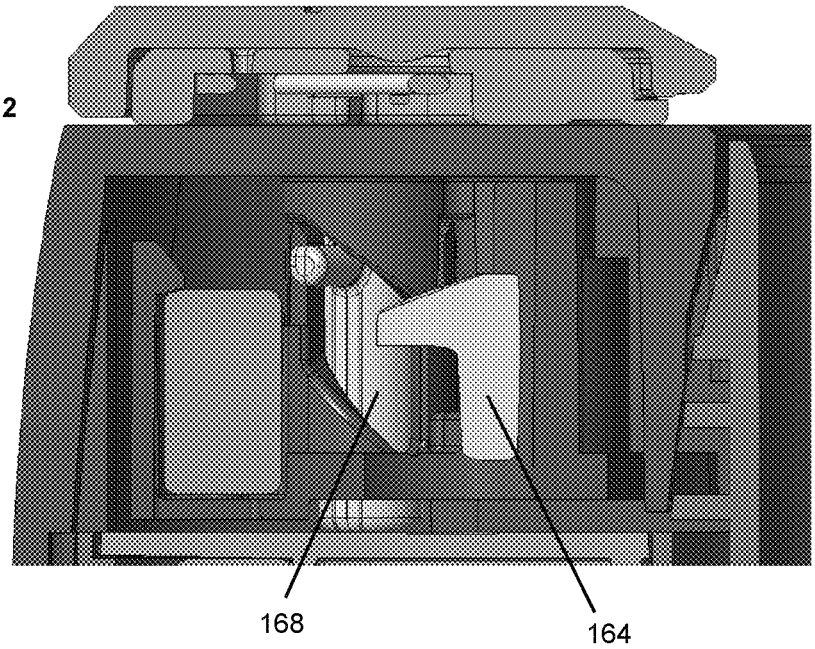

When the cover element 42 reaches the open position, the cam follower 164 is received within a detent 171 defined by the first cam surface 163 of the cam 162, as shown in FIG. 11. When the cam follower 164 is received within the detent 171, the torsion spring 166 is unable to rotate the cam 162 and the cover element 42 back towards the closed position. The release pin 168 remains in its raised position, as shown in FIG. 12.

Figure 13:
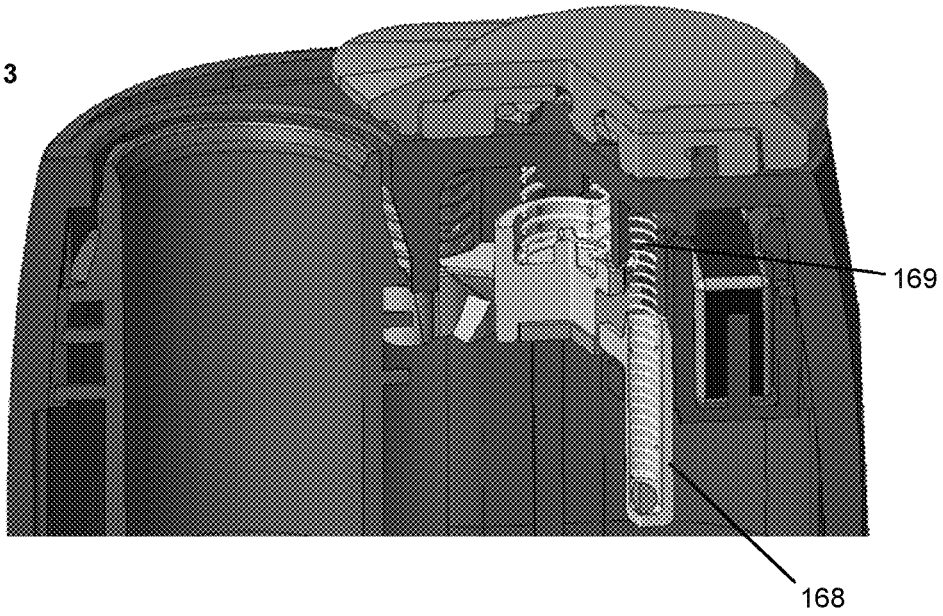
Figure 14:
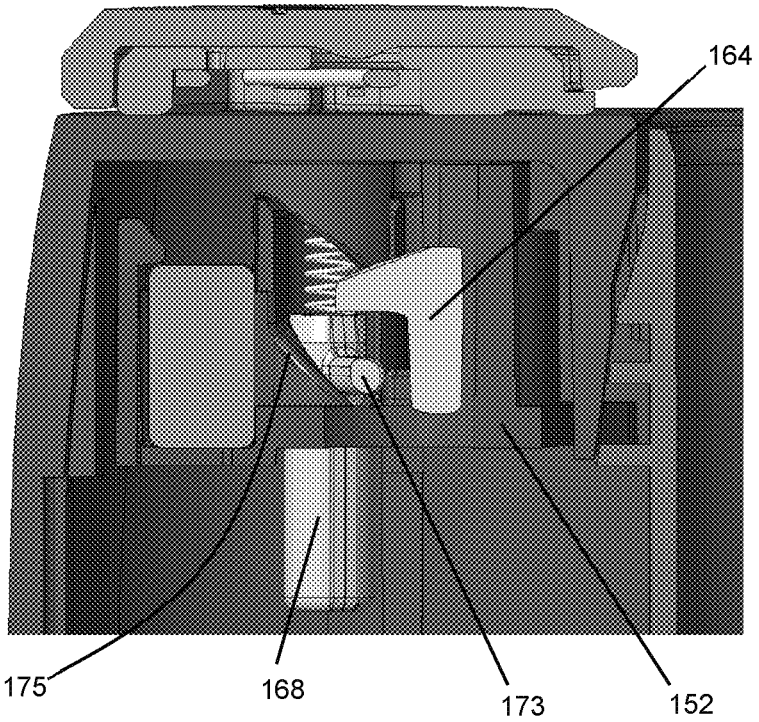

When the second housing 16 is moved away from the first housing 14, the release pin biasing spring 169 pushed the release pin 168 into a lowered position, as shown in FIGS. 13 and 14. During the motion of the release pin 168 into its lowered position, a projection 173 on the release pin 168 engages a second cam surface 175 defined by the chassis 152, which rotates the release pin 168 to position the projection 173 underneath the cam follower 164.

Figure 15:
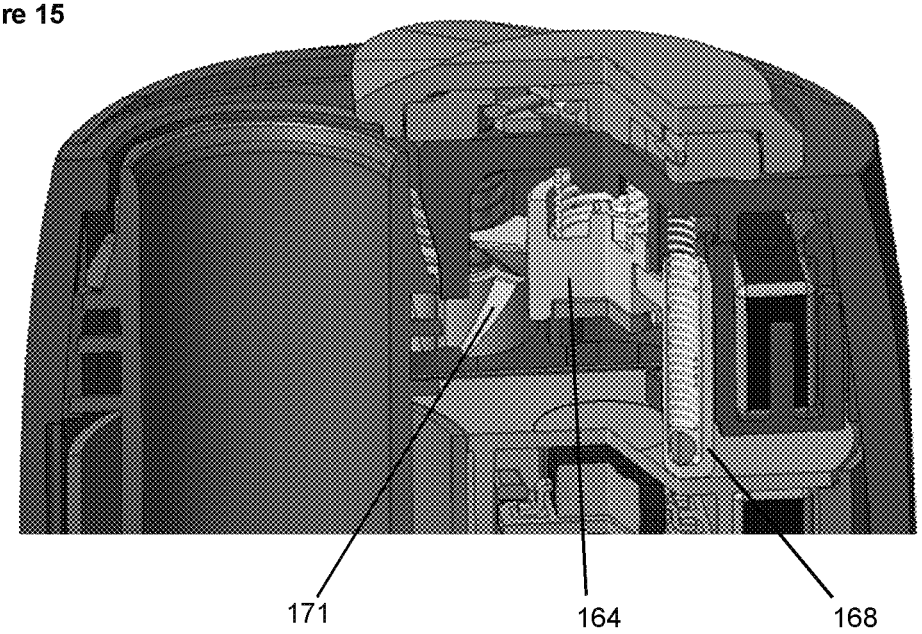
Figure 16:
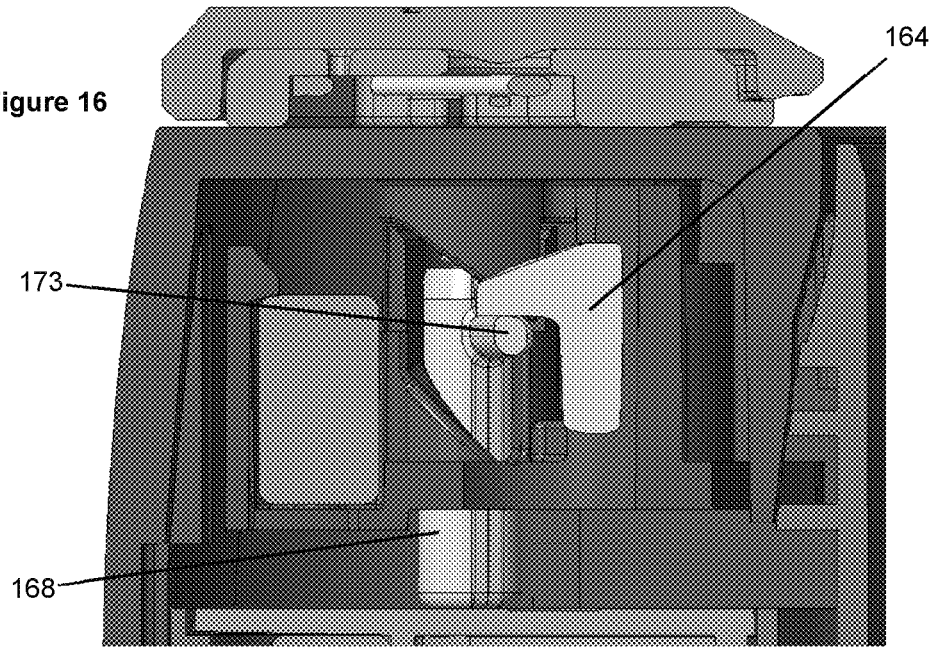

When the second housing 16 is moved towards the first housing 14, the first housing 14 pushes the release pin 168 upwards against the force of the release pin biasing spring 169. As the release pin 168 moves upwards, the projection 173 on the release pin 168 engages the cam follower 164 and pushes the cam follower 164 towards its raised position, as shown in FIGS. 15 and 16. As the cam follower 164 is pushed towards its raised position, the cam follower 164 is disengaged from the detent 171 defined by the first cam surface 163 of the cam 162.

Figure 17:
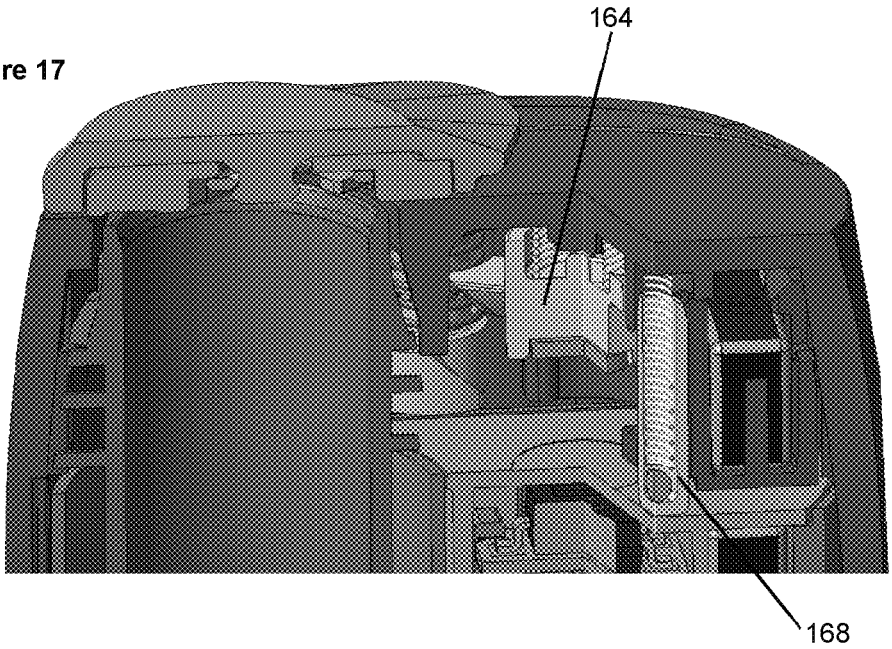
Figure 18:
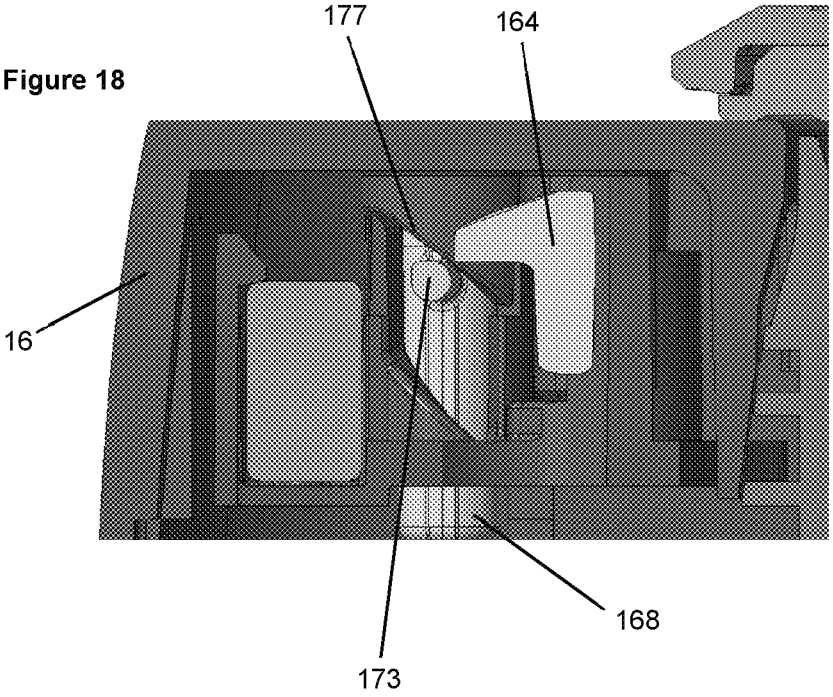

When the cam follower 164 is disengaged from the detent 171 defined by the first cam surface 163 of the cam 162, the torsion spring 166 rotates the cam 162 and returns the cover element 42 to the closed position, as shown in FIG. 17. At the same time, the first housing 14 continues to push the release pin 168 upwards and the projection 173 on the release pin 168 engages a third cam surface 177 defined by the second housing 16. The third cam surface 177 rotates the projection 173 away from the cam follower 164 so that the release pin 168 disengages the cam follower 164, as shown in FIG. 18. At this point, the latching mechanism 158 and the closing mechanism 159 have returned to the initial configurations shown in FIGS. 7 and 8.

Figure 19:
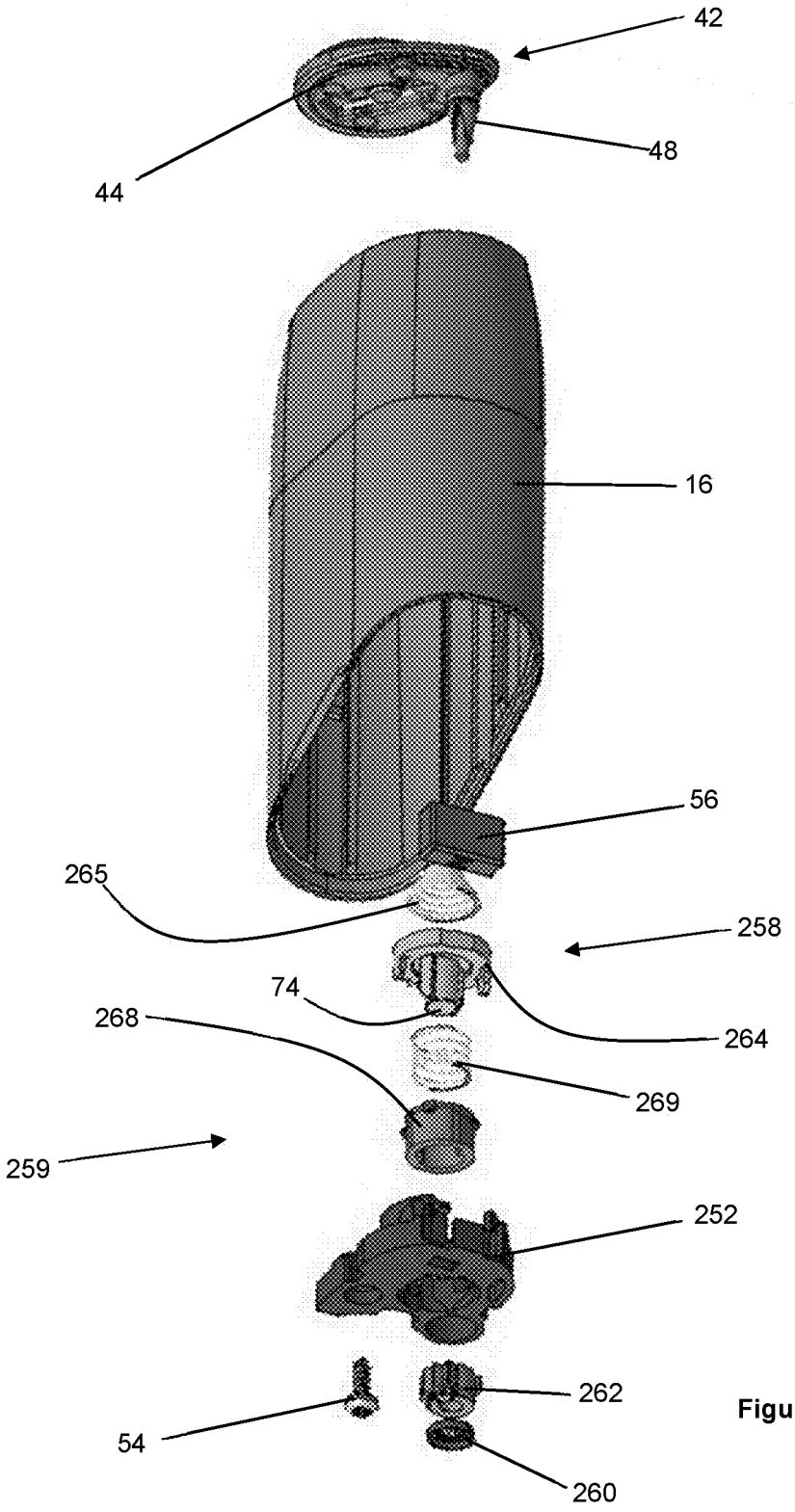
FIG. 19 shows an exploded perspective view of an alternative arrangement of the mechanical linkage of the aerosol-generating device of FIGS. 1 and 2.

FIG. 19 shows an exploded view of an alternative arrangement of the mechanical linkage 50.

The alternative mechanical linkage comprises a chassis 252 attached to the second housing 16 by a screw 54. Mounted onto the chassis 252 is second magnet 56 arranged to interact with the first magnet 28 on the first housing 14. In particular, the first and second magnets 28, 56 are magnetically attracted to each other to facilitate attachment of the second housing 16 to the first housing 14.

Also mounted on the chassis 252 are a latching mechanism 258 and a closing mechanism 259 comprising a washer 260, a first gear 262, a geared cam follower 264, a cam follower biasing spring 265, a release element 268 and a release element biasing spring 269.

The washer 260 is formed from a low friction material to facilitate rotation of the first gear 262 on the chassis 252. The first gear 262 is connected to an end of the shaft portion 48 of the cover element 42 by an interference fit. Therefore, when the cover element 42 is rotated between the closed and open positions, the first gear 262 is also rotated.

The geared cam follower 264 is slidably received within the chassis 252 and engages the first gear 262 and a first cam surface 263 formed by the chassis 252. Therefore, when the first gear 262 rotates during rotation of the cover element 42, the geared cam follower 264 moves up and down within the chassis 252. An indicator element 74 comprising an optically reflective aluminium layer is positioned on a bottom surface of the geared cam follower 264. When the geared cam follower 264 moves up and down within the chassis 252, the sensor 26 senses a change in distance between the sensor 26 and the indicator element 74. Based on the sensed distance between the sensor 26 and the indicator element 74, the sensor 26 provides a signal to the controller 18 indicative of whether the cover element 42 is in the closed position or the open position.

If the signal from the sensor 26 is indicative of the cover element 42 being in the closed position, it is assumed that an aerosol-generating article is not received within the cavity 32 and the controller 18 will not supply power from the power supply 20 to the heater 22 for heating an aerosol-generating article.

If the signal from the sensor 26 is indicative of the cover element 42 being in the open position, an aerosol-generating article may be received within the cavity 32 and the controller 18 may supply power from the power supply 20 to the heater 22 for heating an aerosol-generating article.

If the sensor 26 cannot detect the indicator element 74 it is assumed that the second housing 16 has been detached from the first housing 14. In this case, the sensor 26 provides a signal to the controller 18 indicative of the second housing 16 being detached from the first housing 14 and the controller 18 will prevent the supply of power to the heater 22.

The operation of the latching mechanism 258 and the closing mechanism 259 will now be described with reference to FIGS. 20 to 29.

Figure 20:
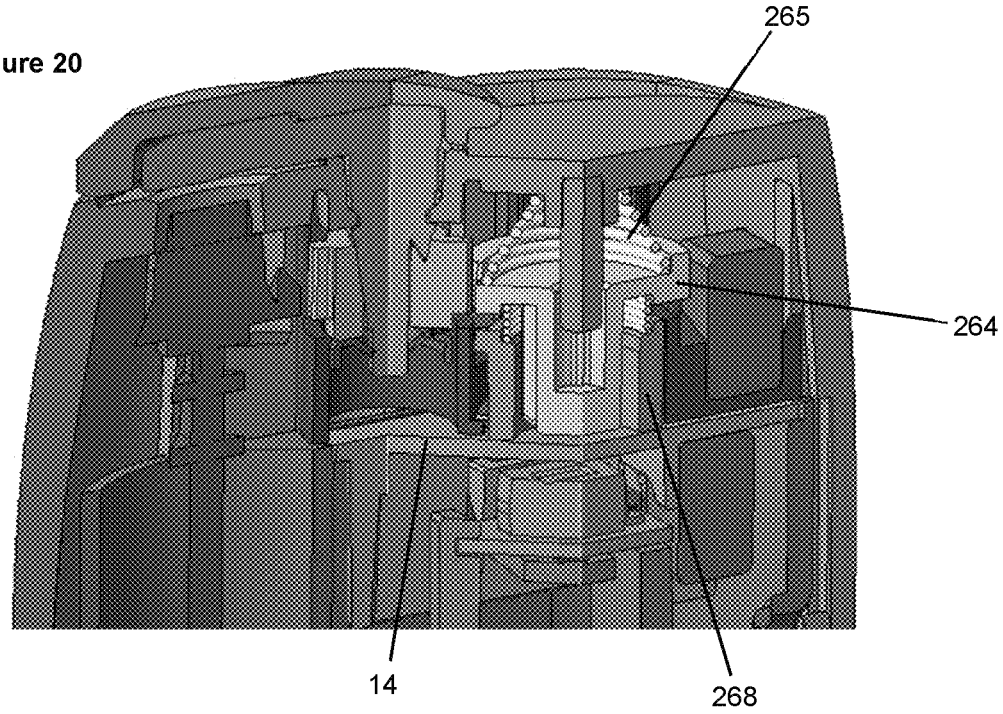
FIGS. 20 to 29 illustrate the operation of the mechanical linkage of FIG. 19.
Figure 21:
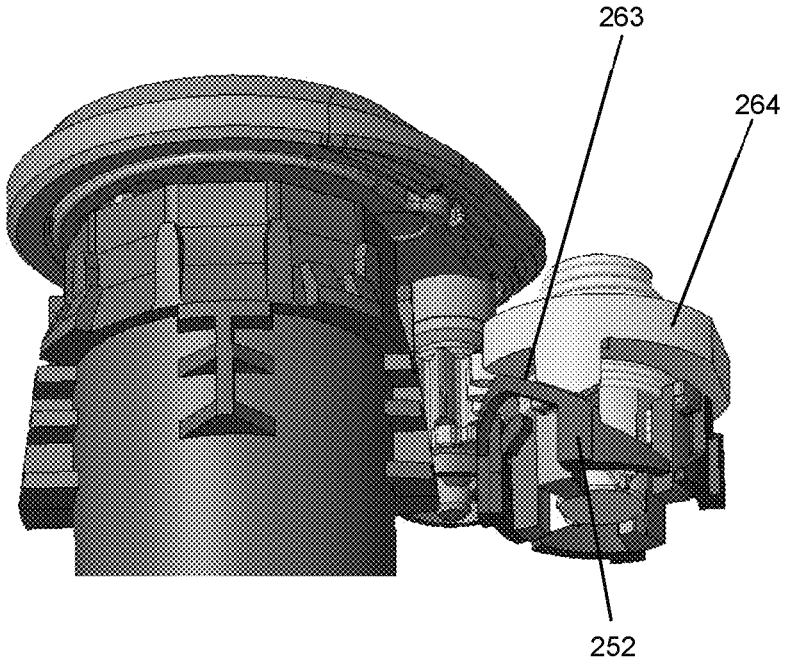
Figure 28:
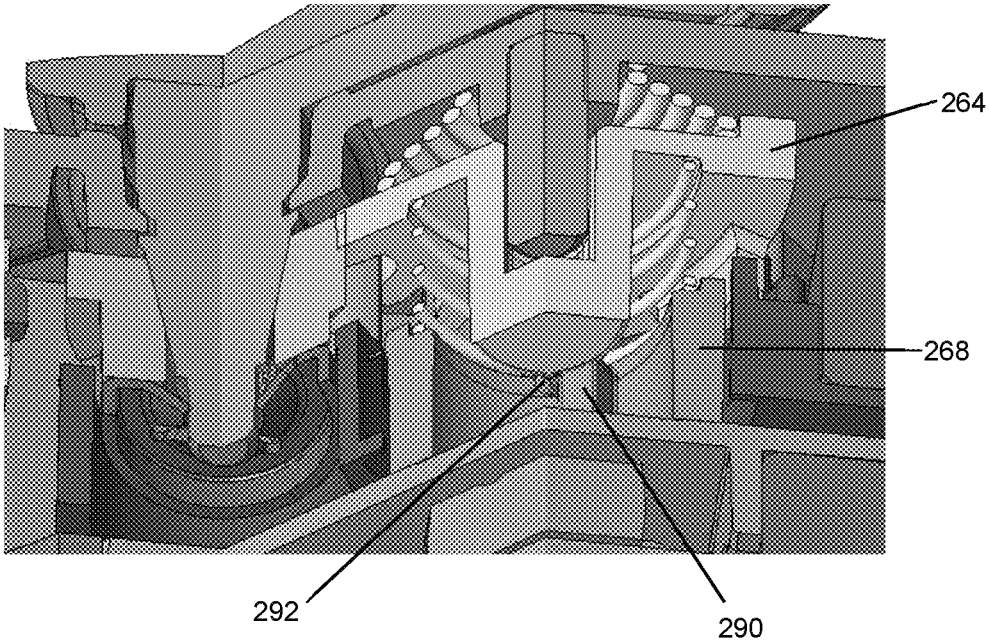
Figure 29:
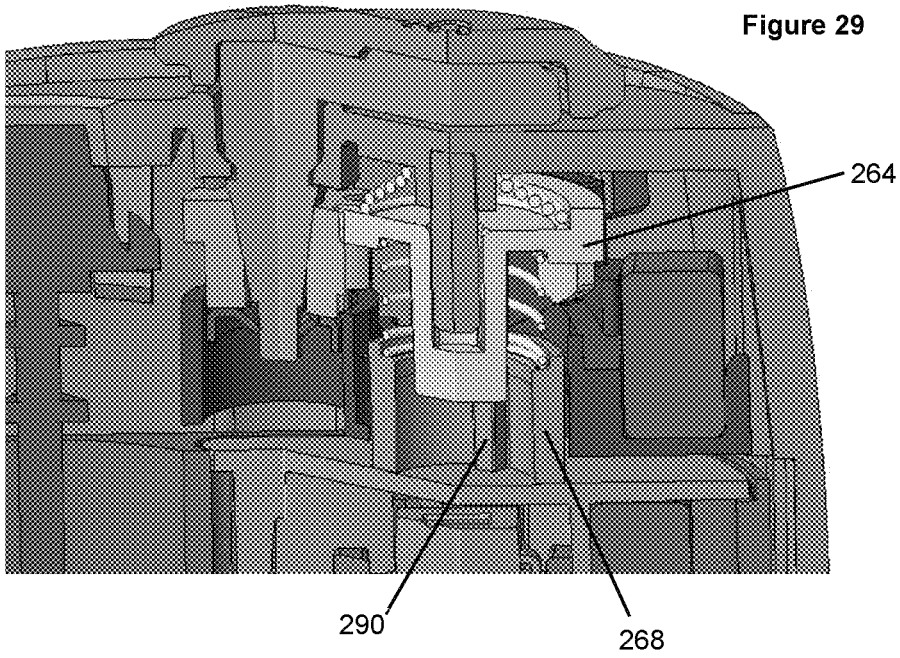

FIG. 20 shows the cover element 42 in the closed position. When the cover element 42 is in the closed position, the geared cam follower 264 is biased into a lowered position by the cam follower biasing spring 265 and the release element 268 is maintained in a raised position by the first housing 14, as shown in FIG. 21. In the raised position, an internal rib 290 on the release element 268 is engaged with an external rib 292 on the geared cam follower 264, as shown in FIGS. 28 and 29.

Figure 22:
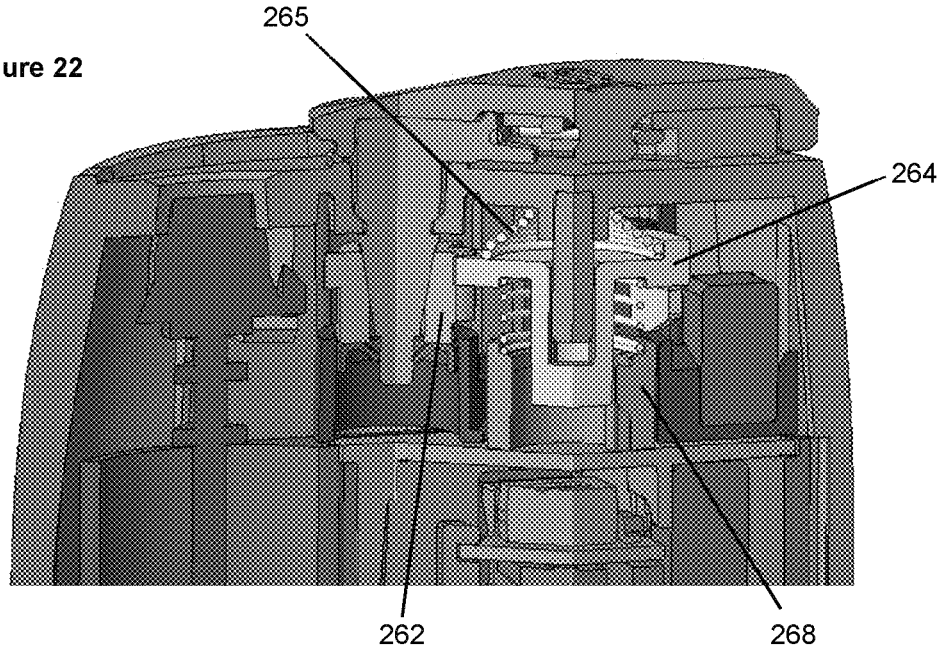
Figure 23:
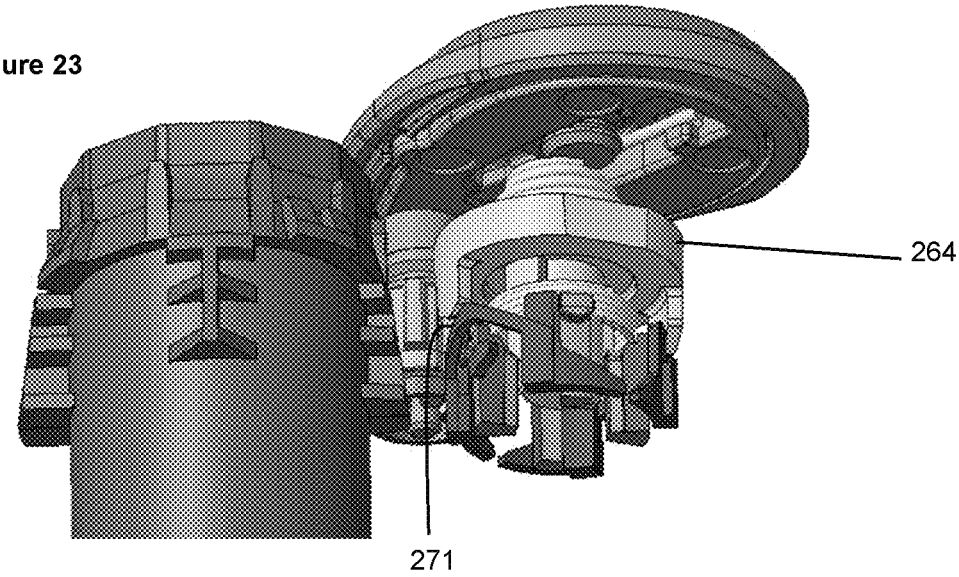

When the cover element 42 is rotated towards the open position, the rotation of the first gear 262 rotates the geared cam follower 264, which rotates the release element 268. During rotation of the geared cam follower 264, the first cam surface 263 raises the geared cam follower 264 into a raised position against the force of the cam follower biasing spring 265, as shown in FIG. 22. When the cover element 42 reaches the open position, the geared cam follower 264 is received within a detent 271 defined by the first cam surface 263, as shown in FIG. 23. When the geared cam follower 264 is received within the detent 271, the cover element 42 cannot be rotated back towards the closed position.

Figure 24:
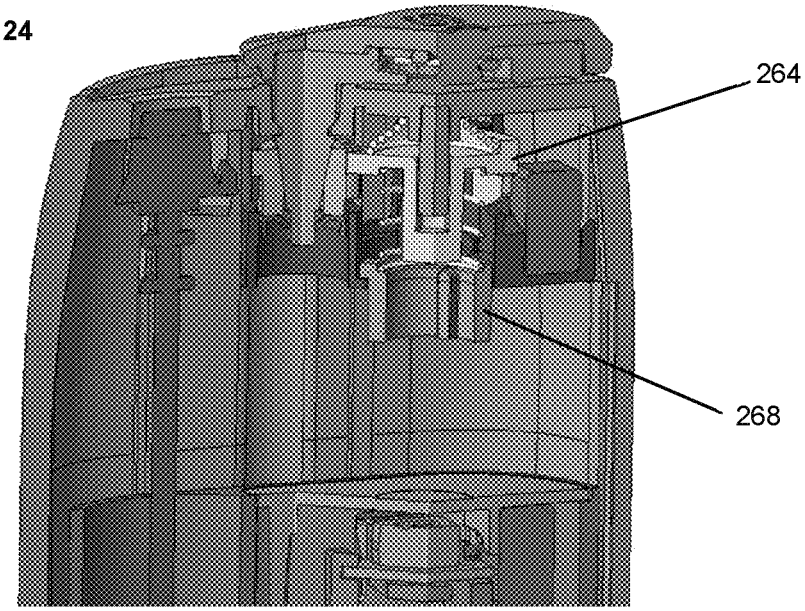
Figure 25:
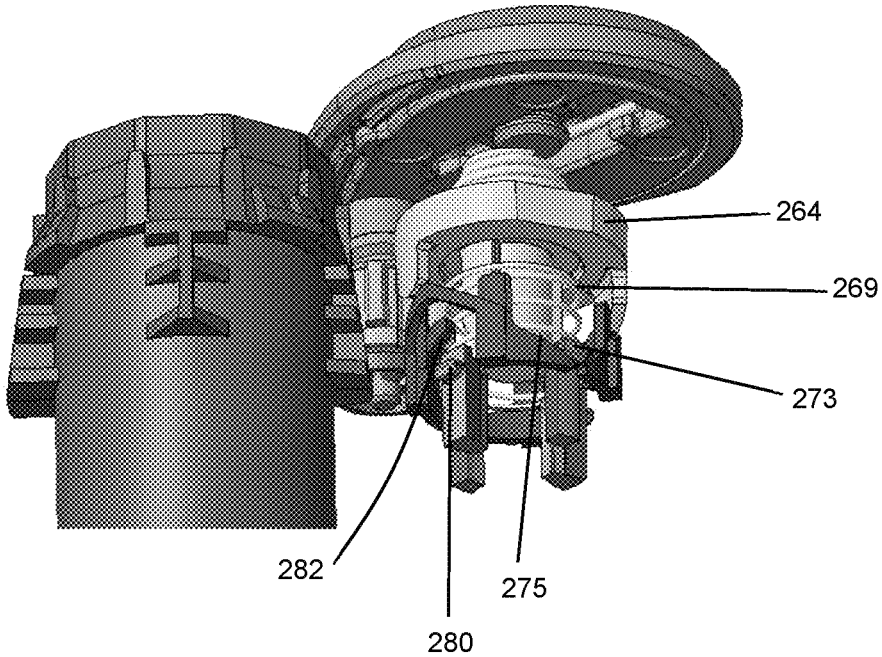

When the second housing 16 is moved away from the first housing 14, the release element biasing spring 269 pushed the release element 268 into a lowered position, which disengages the internal rib 290 on the release element 268 from the external rib 292 on the geared cam follower 264. During the motion of the release element 268 into its lowered position, a first projection 273 on the release element 268 engages a second cam surface 275 defined by the chassis 252, which rotates the release element 268 to a position in which a second projection 280 is positioned underneath a third cam surface 282 defined by the chassis 252, as shown in FIGS. 24 and 25.

Figure 26:
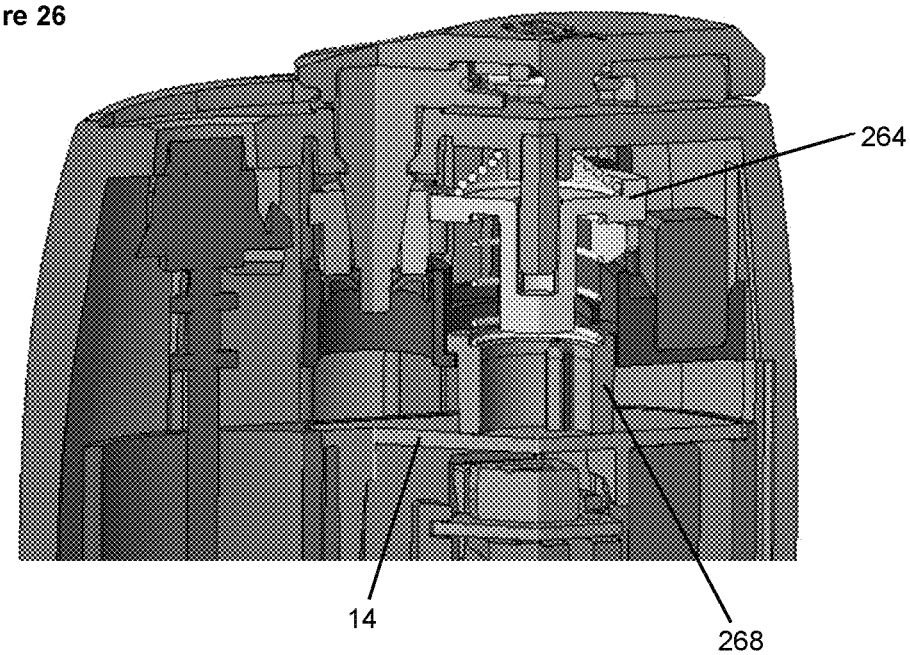
Figure 27:
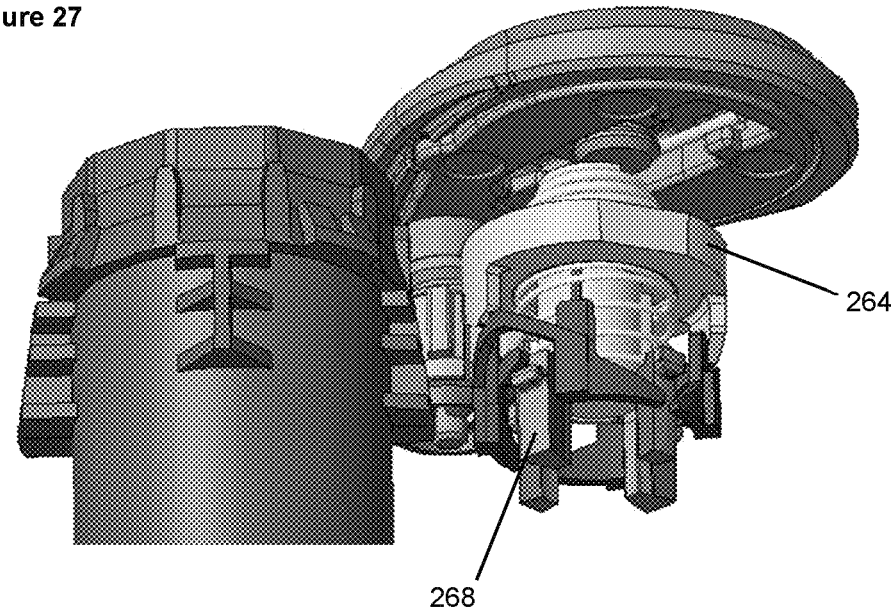

When the second housing 16 is moved towards the first housing 14, the first housing 14 pushes the release element 268 upwards against the force of the release element biasing spring 269, as shown in FIG. 26. As the release element 268 moves upwards, the internal rib 290 on the release element 268 engages the external rib 292 on the geared cam follower 264 and disengages the geared cam follower 264 from the detent 271. At the same time, the second projection 280 on the release element 268 engages the third cam surface 282 as shown in FIG. 27, which rotates the release element 268, the geared cam follower 264 and the cover element back to the initial configuration show in FIGS. 20 and 21.

Figure 30:
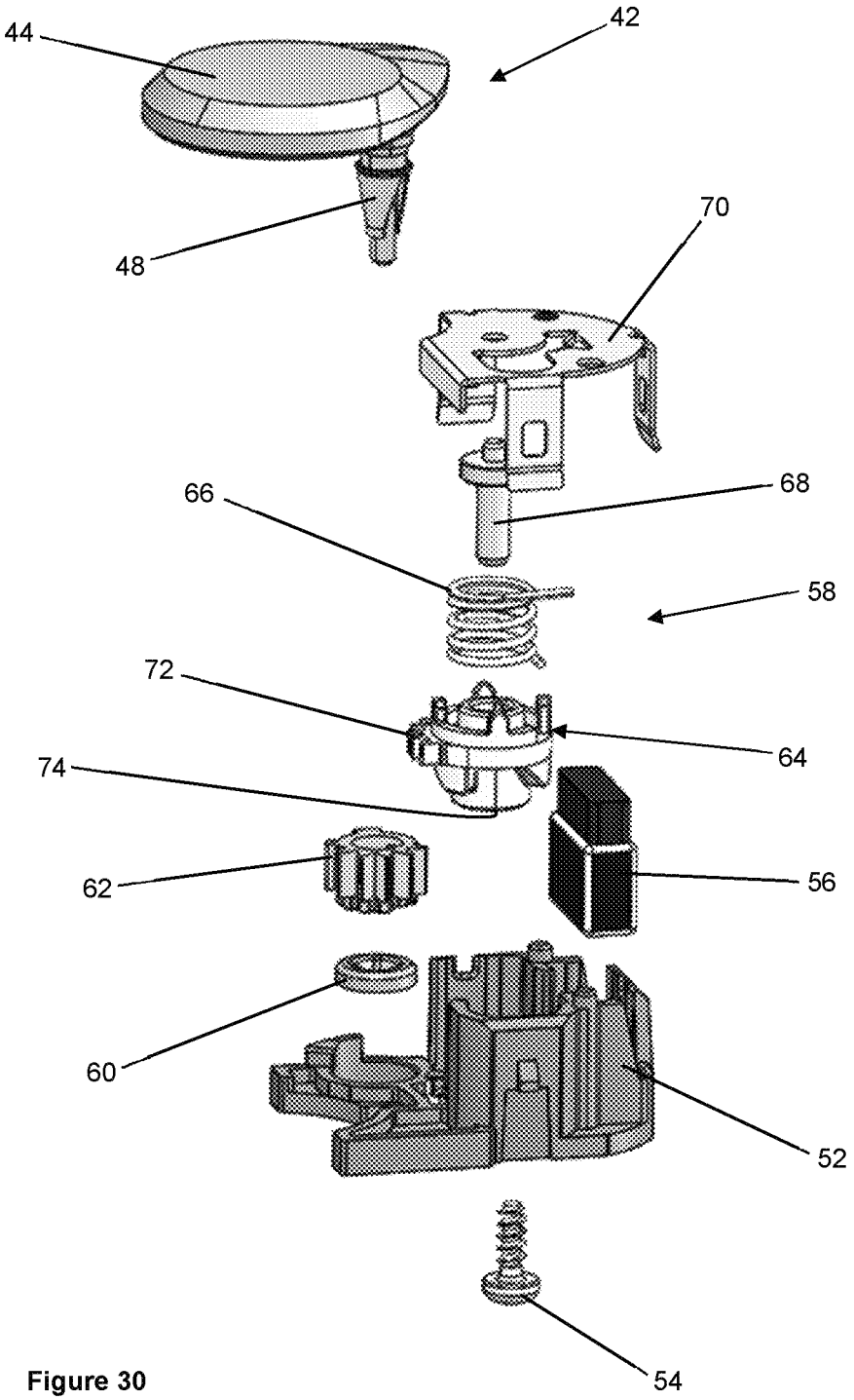
FIG. 30 shows an exploded perspective view of a further alternative arrangement of the mechanical linkage of the aerosol-generating device of FIGS. 1 and 2.
Figure 31:
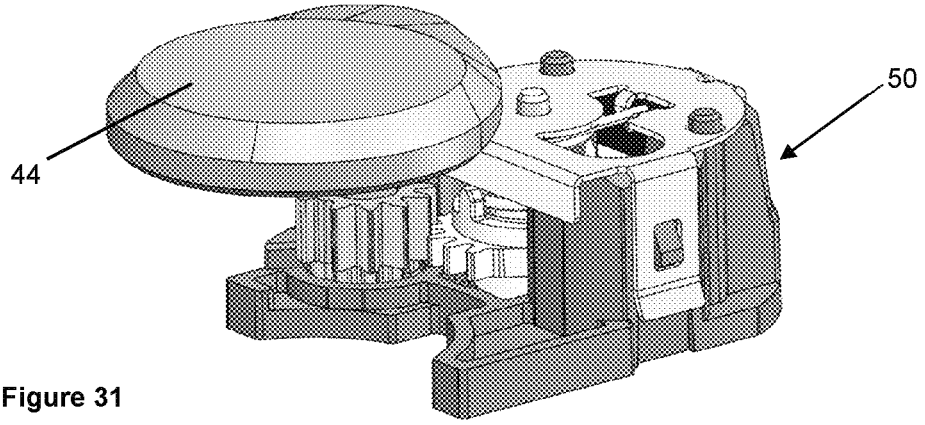
FIG. 31 shows a perspective view of the mechanical linkage of FIG. 30.

FIGS. 30 and 31 show a further alternative arrangement of the mechanical linkage 50.

The further alternative mechanical linkage comprises a chassis 52 attached to the second housing 16 by a screw 54. Mounted onto the chassis 52 is second magnet 56 arranged to interact with the first magnet 28 on the first housing 14. In particular, the first and second magnets 28, 56 are magnetically attracted to each other to facilitate attachment of the second housing 16 to the first housing 14.

Also mounted on the chassis 52 is a biasing mechanism 58 comprising a washer 60, a first gear 62, a spring holder 64, a torsion spring 66, a spindle 68 and a cap 70.

The washer 60 is formed from a low friction material to facilitate rotation of the first gear 62 on the chassis 52. The first gear 62 is connected to an end of the shaft portion 48 of the cover element 42 by an interference fit. Therefore, when the cover element 42 is rotated between the closed and open positions, the first gear 62 is also rotated.

An outer surface of the spring holder 64 forms a second gear 72 that is engaged with the first gear 62. The spring holder 64 is rotatably received within the chassis 52 and engages a cam surface formed on the chassis 52. Therefore, when the spring holder 64 rotates with respect to the cam surface, the spring holder 64 functions as a cam follower and moves up and down along the spindle 68. An indicator element 74 comprising an optically reflective aluminium layer is positioned on a bottom surface of the spring holder 64. When the spring holder 64 moves up and down along the spindle 68, the sensor 26 senses a change in distance between the sensor 26 and the indicator element 74. Based on the sensed distance between the sensor 26 and the indicator element 74, the sensor 26 provides a signal to the controller 18 indicative of whether the cover element 42 is in the closed position or the open position.

If the signal from the sensor 26 is indicative of the cover element 42 being in the closed position, it is assumed that an aerosol-generating article is not received within the cavity 32 and the controller 18 will not supply power from the power supply 20 to the heater 22 for heating an aerosol-generating article.

If the signal from the sensor 26 is indicative of the cover element 42 being in the open position, an aerosol-generating article may be received within the cavity 32 and the controller 18 may supply power from the power supply 20 to the heater 22 for heating an aerosol-generating article.

If the sensor 26 cannot detect the indicator element 74 it is assumed that the second housing 16 has been detached from the first housing 14. In this case, the sensor 26 provides a signal to the controller 18 indicative of the second housing 16 being detached from the first housing 14 and the controller 18 will prevent the supply of power to the heater 22.

A first end of the torsion spring 66 is engaged with the spring holder 64 and a second end of the torsion spring 66 is engaged with the cap 70. When a user rotates the cover element 42 from the closed position to the open position, the spring holder 64 rotates and loads the tension spring 66. When a user releases the cover element 42, the load on the tension spring 66 exerts a rotational force on the spring holder 64, which biases the cover element 42 from the open position towards the closed position.

Figure 32:
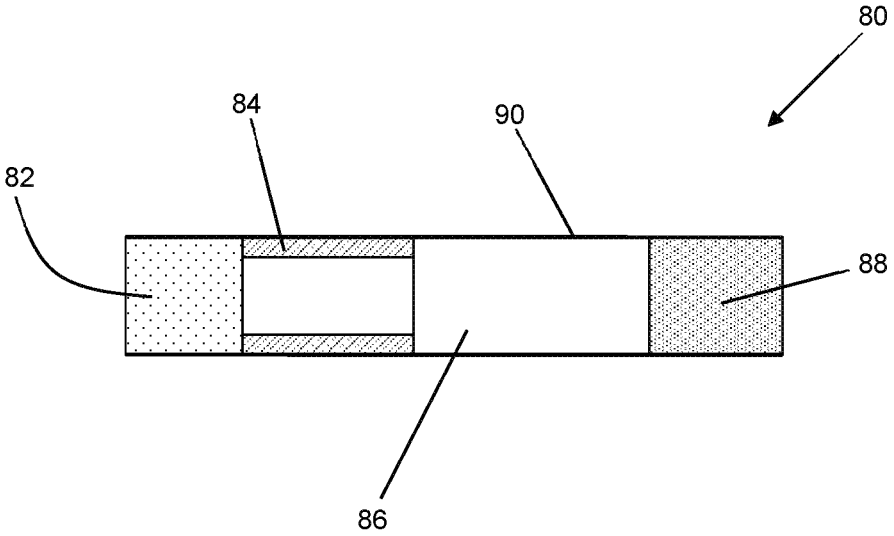
FIG. 32 shows a cross-sectional view of an aerosol-generating article for use with the aerosol-generating device of FIGS. 1 and 2.

FIG. 32 shows a cross-sectional view of an aerosol-generating article 80 for use with the aerosol-generating device 10. The aerosol-generating article 80 comprises an aerosol-forming substrate 82 in the form of a tobacco plug, a hollow acetate tube 84, a polymeric filter 86, a mouthpiece 88 and an outer wrapper 90. When the aerosol-generating article 80 is received within the cavity 32 of the aerosol-generating device 10, the heater 22 is received within the tobacco plug. During use, the heater 22 heats the tobacco plug to generate an aerosol.

The invention claimed is:

1. An aerosol-generating device, comprising:

a housing;

a cavity configured to receive an aerosol-generating article;

an aperture at least partially defined by the housing, wherein the aperture is positioned at an end of the cavity for insertion of the aerosol-generating article into the cavity through the aperture;

a cover element arranged for movement with respect to the housing between a closed position in which the cover element at least partially covers the aperture and an open position in which the aperture is at least partially uncovered;

a sensor arranged to provide an electrical signal indicative of a position of the cover element with respect to the aperture;

an electrical heater arranged to heat the aerosol-generating article when the aerosol-generating article is received within the cavity, wherein the electrical heater is further arranged to extend around an outer surface of the aerosol-generating article received within the cavity; and an indicator element arranged for movement with respect to the sensor when the cover element is moved between the closed position and the open position, wherein the electrical signal provided by the sensor is determined by a position of the indicator element relative to the sensor, wherein the indicator element comprises a magnetic material, and wherein the sensor comprises a Hall effect sensor.

2. The aerosol-generating device according to claim 1, wherein operation of the electrical heater is dependent on the electrical signal provided by the sensor.

3. The aerosol-generating device according to claim 1, further comprising a controller and a power supply, wherein the controller is arranged to control a supply of power from the power supply to the electrical heater in response to a signal received from the sensor.

4. The aerosol-generating device according to claim 3, wherein the controller is further arranged to supply power from the power supply to the electrical heater according to a predetermined heating cycle only when the controller receives a signal from the sensor indicative of the cover element being in the open position.

5. The aerosol-generating device according to claim 2, wherein the electrical heater comprises a resistive heating element or an inductive heating element.

6. The aerosol-generating device according to claim 1, wherein the indicator element is connected to the cover element.

7. The aerosol-generating device according to claim 6, wherein the indicator element is formed separately from the cover element and attached to the cover element.

8. The aerosol-generating device according to claim 1, wherein the cover element is arranged so that, when the cover element is in the closed position, the cover element covers at least 50 percent of the aperture.

9. The aerosol-generating device according to claim 1, wherein the cover element is arranged so that, when the cover element is in the closed position, the cover element covers at least 95 percent of the aperture.

10. The aerosol-generating device according to claim 1, wherein the cover element is arranged so that the cover element entirely covers the aperture when the cover element is in the closed position.

11. The aerosol-generating device according to claim 1, wherein the cover element is arranged so that the cover element covers less than 5 percent of the aperture when the cover element is in the open position.

12. The aerosol-generating device according to claim 1, wherein the cover element is arranged so that the aperture is entirely uncovered when the cover element is in the open position.

13. The aerosol-generating device according to claim 1, wherein the housing comprises an end wall, and wherein the aperture extends through a first portion of the end wall.

14. The aerosol-generating device according to claim 13, wherein the cover element is arranged to overlie a second portion of the end wall when the cover portion is in the open position.

15. The aerosol-generating device according to claim 1, further comprising a biasing mechanism arranged to bias the cover element away from the open position and towards the closed position.

16. The aerosol-generating device according to claim 15, wherein the biasing mechanism comprises a torsion spring.

17. The aerosol-generating device according to claim 15, further comprising a mechanical linkage, the mechanical linkage comprising the biasing mechanism.

18. An aerosol-generating system comprising an aerosol-generating device according to claim 1 and an aerosol-generating article, wherein the aerosol-generating article comprises an aerosol-forming substrate.

* * * * *